US009586074B2

(12) United States Patent
Autogue

(10) Patent No.: US 9,586,074 B2
(45) Date of Patent: Mar. 7, 2017

(54) PORTABLE COLLABORATIVE EXERCISE DEVICE

(71) Applicant: Julien Autogue, Le Sequestre (FR)

(72) Inventor: Julien Autogue, Le Sequestre (FR)

( * ) Notice: Subject to any disclaimer, the term of this patent is extended or adjusted under 35 U.S.C. 154(b) by 0 days.

(21) Appl. No.: 13/846,611

(22) Filed: Mar. 18, 2013

(65) Prior Publication Data

US 2014/0274602 A1 Sep. 18, 2014

(51) Int. Cl.

| | |
|---|---|
| ***A63B 21/02*** | (2006.01) |
| ***A63B 21/00*** | (2006.01) |
| ***A63B 21/055*** | (2006.01) |
| ***A63B 21/28*** | (2006.01) |
| ***A63B 23/02*** | (2006.01) |
| ***A63B 23/035*** | (2006.01) |
| *A63B 23/00* | (2006.01) |

(52) U.S. Cl.

CPC .. *A63B 21/00043* (2013.01); *A63B 21/00065* (2013.01); *A63B 21/00178* (2013.01); *A63B 21/00185* (2013.01); *A63B 21/0552* (2013.01); *A63B 21/28* (2013.01); *A63B 21/4013* (2015.10); *A63B 21/4015* (2015.10); *A63B 21/4019* (2015.10); *A63B 21/4034* (2015.10); *A63B 21/4035* (2015.10); *A63B 23/02* (2013.01); *A63B 23/0355* (2013.01); *A63B 2023/006* (2013.01); *A63B 2210/50* (2013.01); *A63B 2225/09* (2013.01)

(58) Field of Classification Search

CPC ... A63B 21/02; A63B 21/055; A63B 21/0557; A63B 21/1426; A63B 21/1438; A63B 21/1488; A63B 21/28; A63B 21/285; A63B 23/04; A63B 23/08; A63B 21/00043; A63B 21/4013; A63B 21/4019; A63B 21/00185; A63B 21/4015; A63B 21/4035; A63B 21/4034

USPC ..... 482/92, 121–126, 129, 139, 906

See application file for complete search history.

(56) References Cited

U.S. PATENT DOCUMENTS

| | | | | |
|---|---|---|---|---|
| 1,340,904 | A | | 11/1919 | Medart et al. |
| 1,706,654 | A | * | 3/1929 | Christesen ..... 482/125 |
| 3,519,269 | A | | 7/1970 | Howlett et al. |
| 3,593,708 | A | | 7/1971 | Steele |
| 4,245,840 | A | * | 1/1981 | Van Housen ..... 482/124 |
| 4,528,944 | A | | 7/1985 | Reed et al. |
| 4,606,539 | A | | 8/1986 | Farnham |
| 4,627,617 | A | | 12/1986 | Gilmore et al. |
| 4,685,671 | A | | 8/1987 | Hagerman et al. |
| 4,763,901 | A | | 8/1988 | Richter |
| 4,828,253 | A | | 5/1989 | Schicketanz |

(Continued)

*Primary Examiner* — Loan H Thanh
*Assistant Examiner* — Gregory Winter
(74) *Attorney, Agent, or Firm* — Milord A. Keshishian

(57) ABSTRACT

An exercise device that is simultaneously mutually beneficial for exercising partners with one exercising by providing a continuously changing resistance and resistance-vector while simultaneously the other exercising by providing a continuously adapting (or altering) counteracting force and counteracting force-vector to the continuously changing resistance and resistance vector. In addition, the portable collaborative exercise device in accordance with one or more embodiments enables correct application of resistance between symmetrical set of muscles with unbalanced strengths, and enables immediate ceasing of an exercise routine if the resistance is incorrectly applied.

18 Claims, 33 Drawing Sheets

(56) References Cited

U.S. PATENT DOCUMENTS

| | | | | |
|---|---|---|---|---|
| 4,979,732 | A | 12/1990 | Rushatz et al. | |
| 5,009,414 | A | 4/1991 | Bass | |
| 5,167,601 | A | 12/1992 | Frappier | |
| 5,167,602 | A | 12/1992 | Lehktman | |
| 5,284,459 | A | 2/1994 | Podd, III | |
| 5,518,480 | A | 5/1996 | Frappier | |
| 5,803,881 | A | 9/1998 | Miller | |
| 5,944,640 | A | 8/1999 | Larsson | |
| 5,951,443 | A | 9/1999 | Askins | |
| 6,102,837 | A | 8/2000 | Hubbard | |
| 6,250,699 | B1 * | 6/2001 | Robertson | A01M 31/006 294/152 |
| 6,322,483 | B1 | 11/2001 | Rotella | |
| D453,035 | S | 1/2002 | Giles | |
| 6,338,700 | B1 * | 1/2002 | Pollock | A63B 21/154 482/904 |
| 6,348,026 | B1 | 2/2002 | Kuo | |
| 6,540,651 | B1 | 4/2003 | Aberton et al. | |
| 6,666,789 | B2 | 12/2003 | Lee | |
| 7,044,896 | B2 | 5/2006 | Hetrick | |
| 7,090,622 | B2 | 8/2006 | Hetrick | |
| 7,104,931 | B2 | 9/2006 | Saul | |
| 7,179,206 | B2 | 2/2007 | Backes et al. | |
| 7,255,666 | B2 | 8/2007 | Cardenas | |
| 7,909,748 | B2 | 3/2011 | Calvagne et al. | |
| 7,955,236 | B2 * | 6/2011 | DiGiovanni et al. | 482/124 |
| 8,007,419 | B2 | 8/2011 | Dieter et al. | |
| 8,016,335 | B2 * | 9/2011 | McKay | A62B 35/0006 294/141 |
| 8,075,462 | B1 | 12/2011 | Hinds et al. | |
| 8,083,653 | B2 * | 12/2011 | Hetrick | 482/91 |
| 8,142,336 | B1 * | 3/2012 | Yates | 482/124 |
| 8,282,536 | B2 * | 10/2012 | Latronica | 482/121 |
| 8,317,667 | B1 * | 11/2012 | Thomas | 482/121 |
| 8,979,716 | B1 * | 3/2015 | Rawlins | A63B 21/0442 482/129 |
| 2004/0082445 | A1 | 4/2004 | Zabel | |
| 2005/0192169 | A1 * | 9/2005 | Girgen et al. | 482/139 |
| 2005/0227833 | A1 * | 10/2005 | Wilkinson | 482/124 |
| 2007/0173383 | A1 * | 7/2007 | Feigenbaum et al. | 482/91 |
| 2009/0075790 | A1 * | 3/2009 | Hetrick | A63B 21/0023 482/92 |
| 2010/0292055 | A1 * | 11/2010 | Andrich | 482/122 |
| 2012/0035031 | A1 * | 2/2012 | Silverman et al. | 482/139 |
| 2012/0329618 | A1 * | 12/2012 | White et al. | 482/126 |
| 2014/0274569 | A1 * | 9/2014 | Lewen | A63B 7/02 482/24 |

* cited by examiner

PORTABLE COLLABORATIVE EXERCISE DEVICE

BACKGROUND OF THE INVENTION

Field of the Invention

The present invention relates to an exercise device and, more particular to a portable collaborative exercise device that is simultaneously mutually beneficial for exercising partners.

Description of Related Art

Conventional exercise devices using adjustable inelastic straps are well known and have been in use for a number of years. Regrettably, most conventional exercise devices using adjustable inelastic straps suffer from obvious disadvantages in that they are used for exercising by only one individual and without a partner rather than a simultaneous workout with a partner. An important drawback of most conventional exercise devices using adjustable inelastic straps is that the maximum resistance provided is limited by the full body weight of the exercising individual. A further drawback is that they are tailored for exercise routines to workout the upper body rather than both upper and lower body. That is, most do not have the means to provide a complete set of exercises for a lower body and upper body workouts.

Since the conventional exercise devices using adjustable inelastic straps require the use of an immobile (stationary or static) stable structure as an anchor (for safety) to counter the body weight of the exercising individual, the resistance and the resistance-vector provided by the static stationary anchor during execution of the exercise is obviously also constant. This constant resistance and the resistance-vector provided by the static and stationary anchor means that the exercising individual's counteracting force and counteracting force-vector in relation to the provided resistance and resistance-vector is also constant, which reduces efficiencies in terms of building and strengthening muscles.

Additionally, most conventional exercise devices (including conventional adjustable inelastic straps that are used for exercise) may only provide resistance and resistance-vector to maximize only one of a concentric, eccentric, or isometric contractions of the muscle during its full range of motion while exercising, rather than all three types of contractions for the same exercise. That is, most conventional exercise devices do not isolate muscle contractions in terms of concentric, eccentric, and isometric contractions, but apply the same resistance for the full range of motion of the muscle (this even includes the use of free weights such as dumbbells). For example, using the full body weight (i.e., a constant resistance), a user of a conventional adjustable inelastic strap may maximize concentric contractions of a particular muscle group during a first part of the exercise while providing a much less efficient isometric and eccentric contractions of the same muscle group during a remaining range of motion of the same muscles for the same exercise. That is, the eccentric contractions may require a higher level of resistance for a more efficient workout (maximum yield in muscle capacity and increased strength) verses the concentric contractions, which may not be accomplished if the same constant resistance (i.e., maximum body weight) is applied to both concentric and eccentric contractions.

Further, most conventional adjustable inelastic straps that are used for exercise lack the needed adaptive response in terms of resistance and resistance vector to compensate for unbalanced strengths between symmetrical muscle groups (e.g., right-side verses the left side muscle groups of an exercising individual for the same, identical exercise routine). In most cases, unbalanced strengths between symmetrical muscle groups leads to injury or greater increase in imbalance in strength between the muscle groups as the stronger muscle groups tend to dominate and compensate for the weaker.

Additionally, most conventional exercising devices (free weights, machine weights, or adjustable inelastic straps, etc.) that are used for exercise lack the needed adaptive response in terms of resistance and resistance vector to immediately stop an exercise routine if the exercising individual incorrectly performs the exercise. With almost all conventional exercising devices, incorrect application of resistance may lead to injury without any means to stop the resistance on time. For example, when using free weights, by the time an exercising individual abruptly drops the free weights due to feeling of pain as a result of incorrect lifting of the weight (incorrect application of resistance), the body may have already experienced minor injury.

Accordingly, in light of the current state of the art and the drawbacks to current exercising devices mentioned above, a need exists for a portable, collaborative exercise device that would enable participation of an exercising partner, not limit the maximum resistance to the body weight of the exercising individual, and would provide full exercise routine for both the upper and lower body. Further, a need exists for such an exercise device that would be simultaneously mutually beneficial for exercising partners with one exercising by providing a continuously changing resistance and resistance-vector while simultaneously the other exercising by providing a continuously adapting (or altering) counteracting force and counteracting force-vector to the continuously changing resistance and resistance vector. In addition, a need exists for an exercise device that would enable correct application of resistance between symmetrical set of muscles with unbalanced strengths, and enable immediate ceasing of an exercise routine if the resistance is incorrectly applied.

BRIEF SUMMARY OF THE INVENTION

A non-limiting, exemplary aspect of an embodiment of the present invention provides an exercise device, comprising:

one or more resistance module for providing resistance and resistance-vector; and one or more strengthening modules for providing counteracting force and counteracting-vector force to the resistance and resistance vector.

Another non-limiting, exemplary aspect of an embodiment of the present invention provides a method for a collaborative exercise, comprising:

providing independently controlled and continuously changing resistance and resistance-vector while simultaneously providing independently controlled and continuously adaptive responsive counteracting force and counteracting force-vector to the continuously changing resistance and resistance vector.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

FIGS. 8A-1 to 8F-2 are non-limiting, non-exhaustive, merely exemplary illustrations of a few upper and lower body exercise routines using the exercise device shown in FIGS. 1 to 7D in accordance with the present invention.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

In the description given below, when it is necessary to distinguish the various members, elements, sections/portions, components, or any other aspects (functional or otherwise) or features of a device or devices from each other, the description will follow reference numbers with a small alphabet character such as (for example) "resistance module 102*a*, 102*b*, etc." If the description is common to all of the various members, elements, sections/portions, components, or any other aspects (functional or otherwise) or features of a device or devices such as (for example) to all resistance modules 102*a*, 102*b*, etc., then they are simply referred to with reference number only and with no alphabet character such as (for example) "resistance module 102." The present invention defines a vector as a quantity having direction as well as magnitude.

One or more embodiments of the present invention provide a portable, collaborative exercise device that enables participation of an exercising partner, does not limit the maximum resistance to the body weight of the exercising individual, and allows for full exercise routine for both the upper and lower body.

The portable, collaborative exercise device in accordance with one or more embodiments disclosed is simultaneously mutually beneficial for exercising partners with one exercising by providing a continuously changing resistance and resistance-vector while simultaneously the other exercising by providing a continuously adapting (or altering) counteracting force and counteracting force-vector to the continuously changing resistance and resistance vector. In addition, the portable collaborative exercise device in accordance with one or more embodiments enables correct application of resistance between symmetrical set of muscles with unbalanced strengths, and enables immediate ceasing of an exercise routine if the resistance is incorrectly applied.

Figure 1:
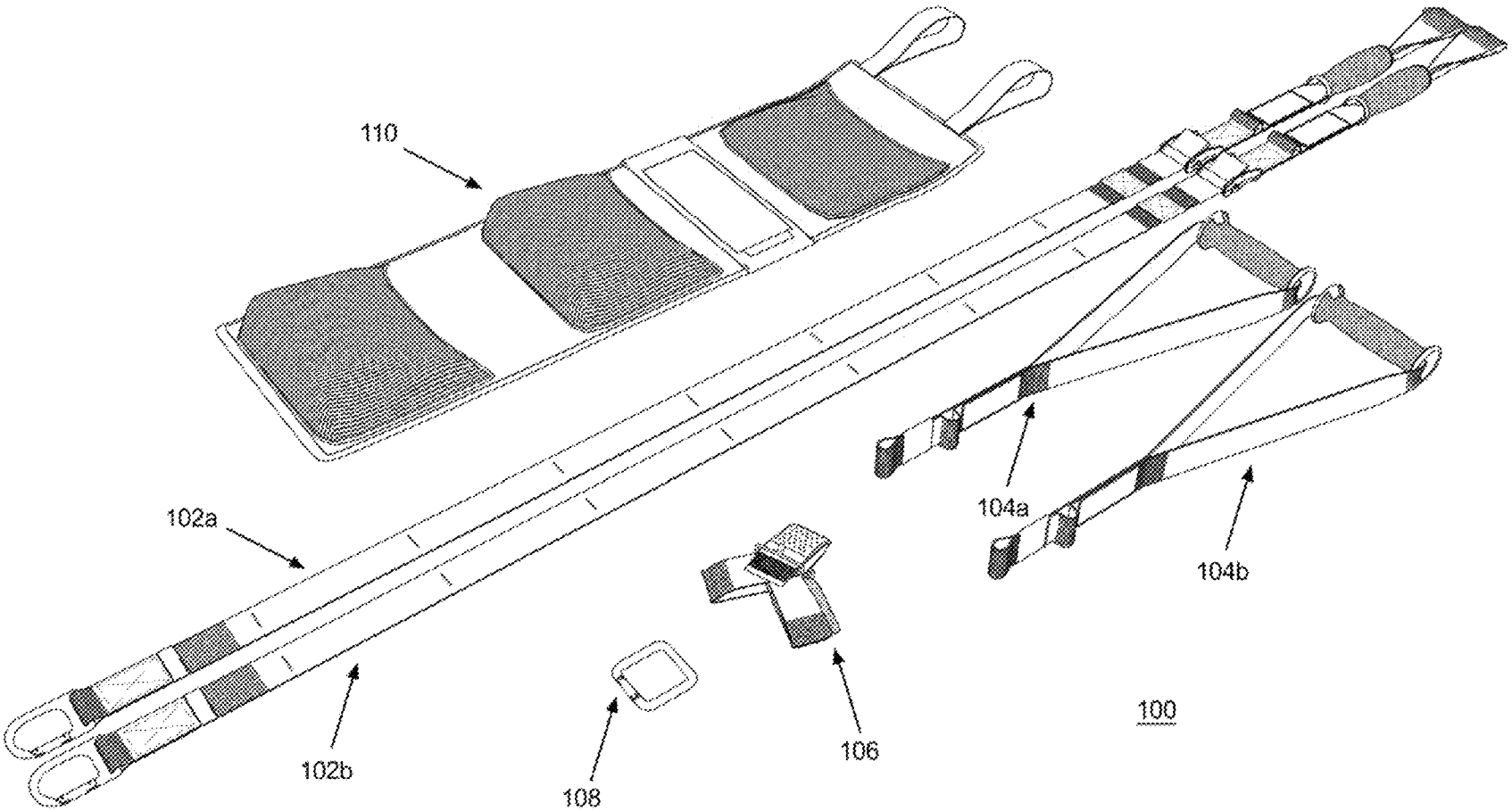
FIG. 1 is a non-limiting, exemplary illustration of various components that exemplarily constitute an exercise device in accordance with the present invention.

FIG. 1 is a non-limiting, exemplary illustration of various components that exemplarily constitute an exercise device in accordance with the present invention. As illustrated in FIG. 1, the portable, collaborative exercise device 100 of the present invention includes one or more resistance module 102 for providing resistance and resistance-vector for exercise, and one or more strengthening modules 104 (and an ankle strap 106) for providing counteracting force and counteracting-vector force to the resistance and resistance vector, which is provided by the one or more resistance module 102. The resistance module 102, the strengthening module 104, and the ankle strap 106 are comprised of well-known and conventional inelastic flat straps (e.g., webbing). The portable, collaborative exercise device 100 further includes a stabilizer 108 (detailed below) and a portable carrying case 110 (also detailed below).

Figure 2A:
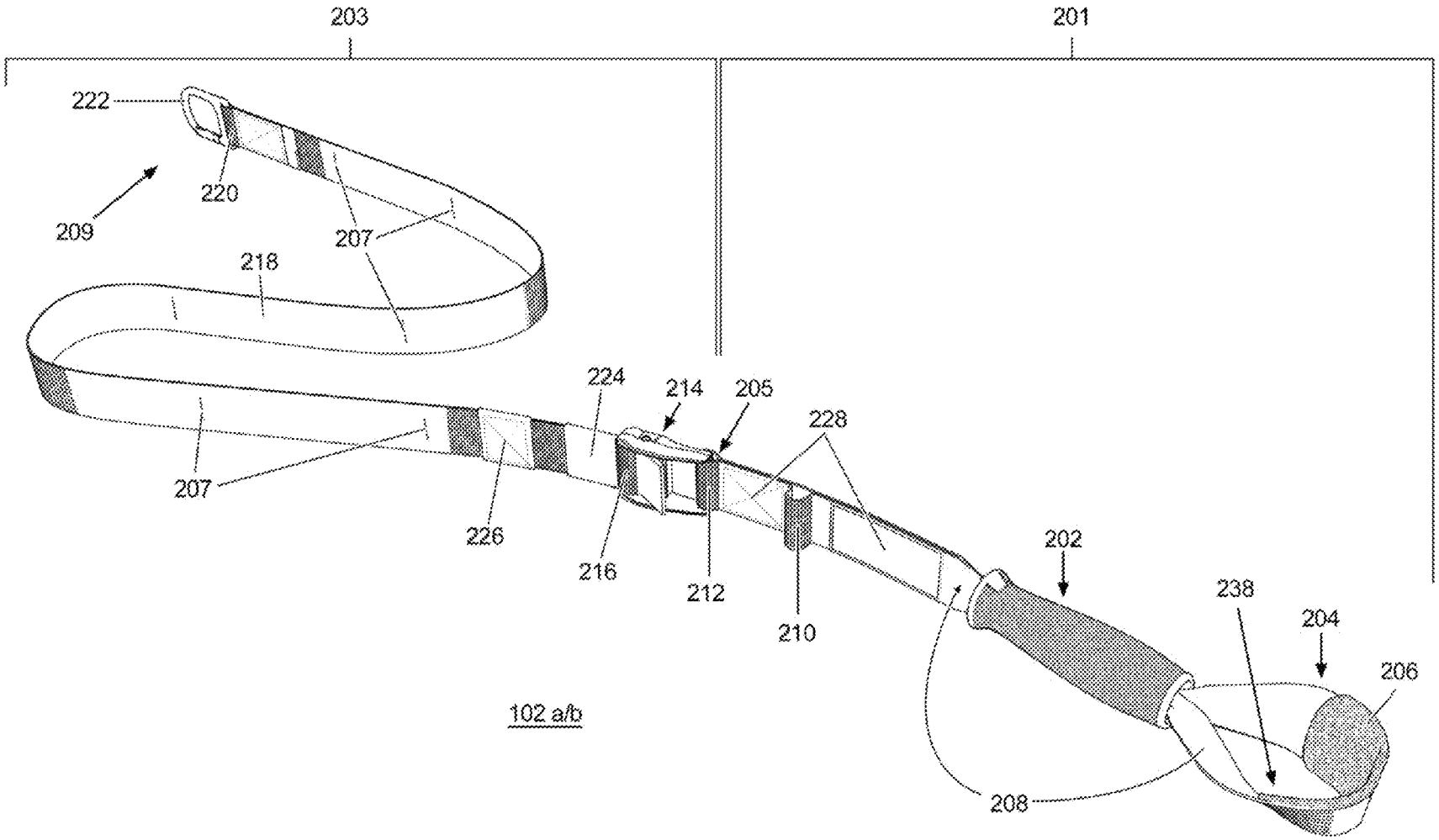
FIGS. 2A to 2C are non-limiting, exemplary illustrations detailing resistance modules of the exercise device shown in FIG. 1 in accordance with the present invention.
Figure 2B:
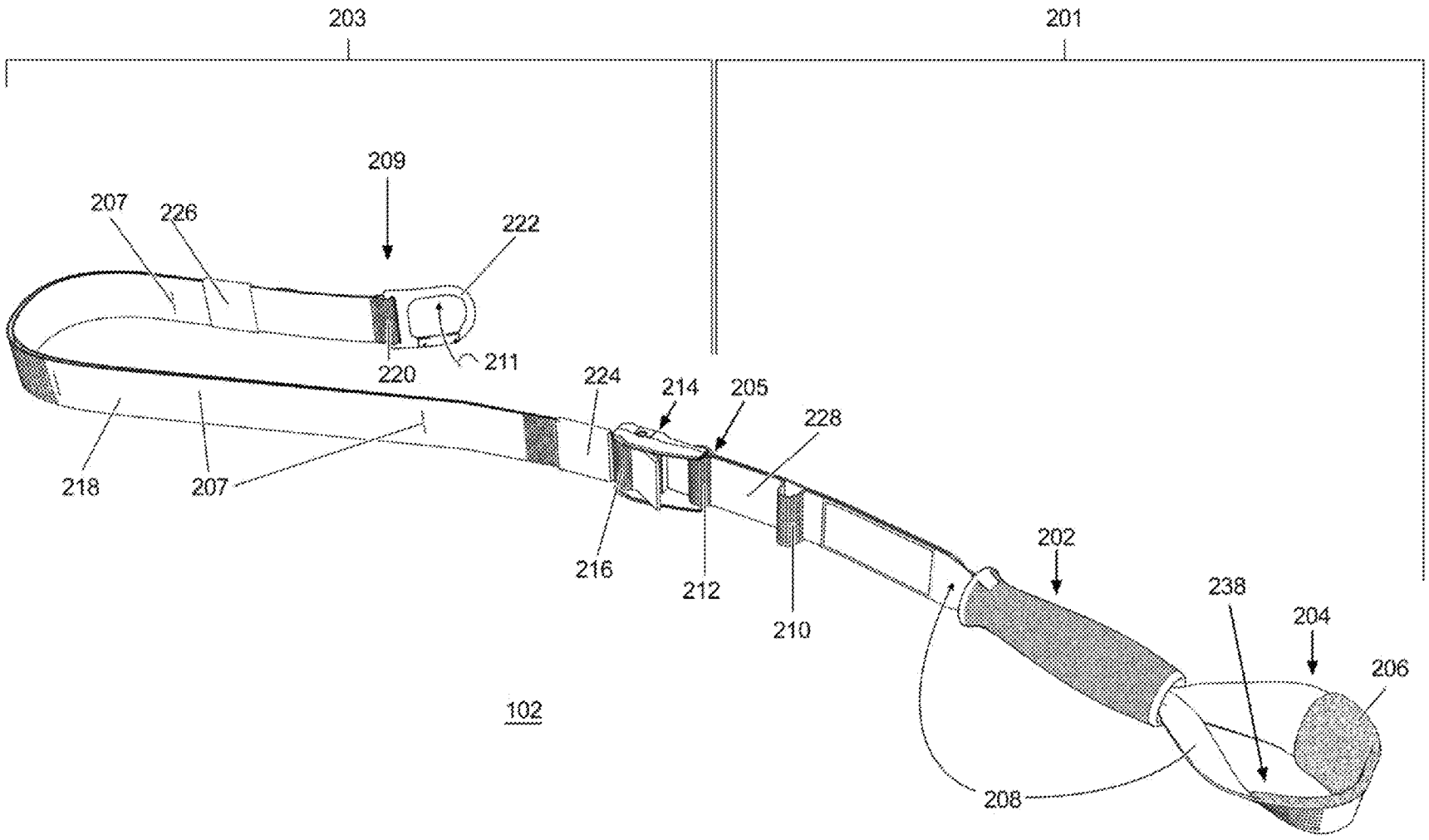
Figure 2C:
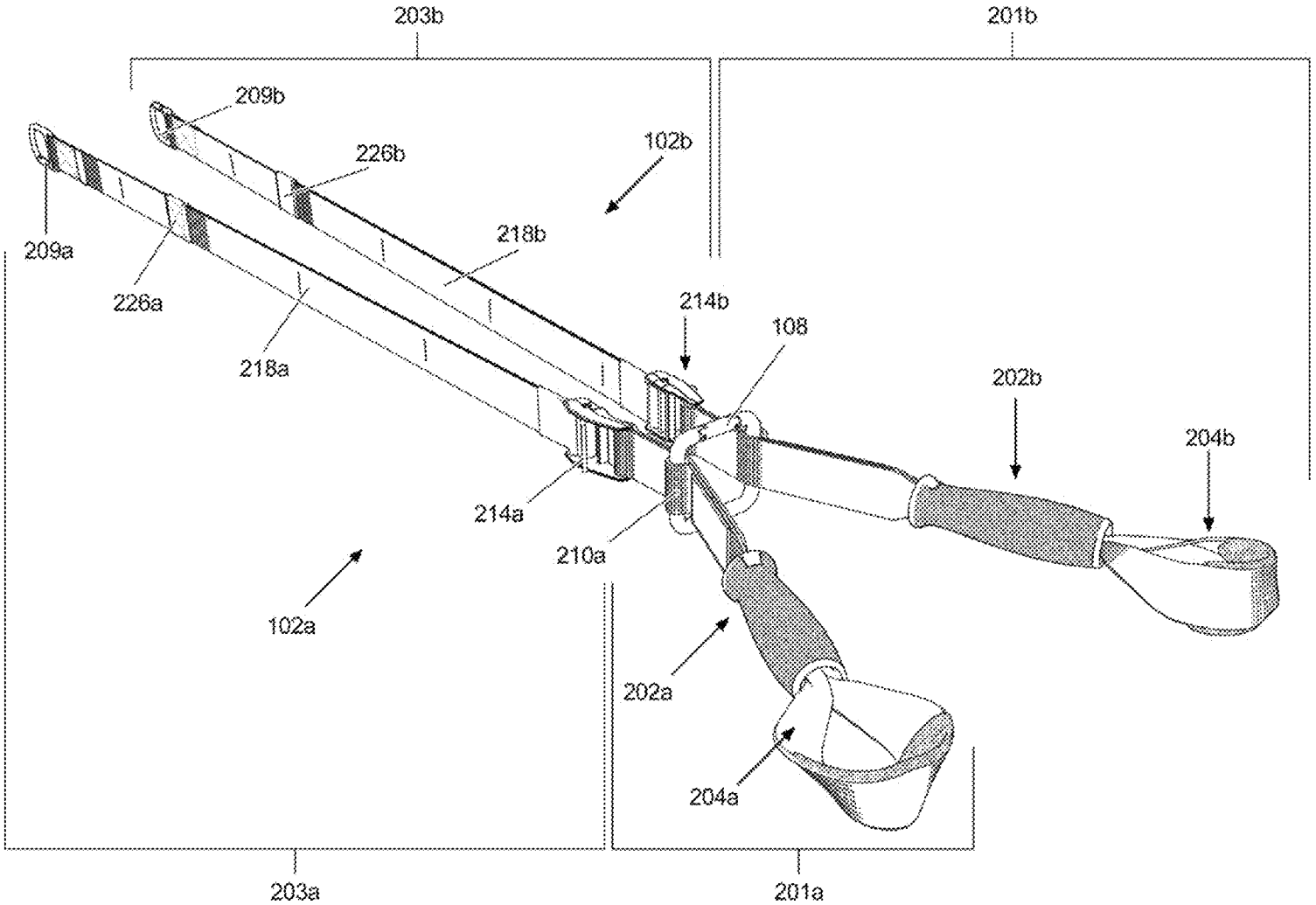

FIGS. 2A to 2C are non-limiting, exemplary illustrations detailing a resistance module of the exercise device shown in FIG. 1 in accordance with the present invention. As illustrated in FIGS. 1 to 2C, the one or more resistance module 102 is comprised of a control member 201 and an adjusting member 203. The adjusting member 203 (detailed below) and its associated buckle (e.g., a cam buckle) are very well known and conventional mechanisms. The control member 201 includes a first end 204 comprised of a strap 208 formed into a longitudinally extending loop 238 for a firm grip for independent, controlled application of resistance and resistance-vector. The control member 201 further includes a second end 205 comprised of a transversally oriented loop 212 for coupling with the adjusting member 203 via a buckle 214 in a non-limiting, exemplary form of a cam buckle 214.

The longitudinally extending loop 238 of the control member 201 includes a middle loop strap 206 that is cushioned using (for example) a neoprene padding stitched thereon for added comfort for use. The strap 208 includes the free ends of the loop 238 that pass through a conventional handle 202 and are stitched together at first stitching 228 (with an intervening, transversally oriented, laterally positioned loop 210, which is detailed below). The handle 202 is ergonomic with a substantially cylindrical through-hole that enables the passage of the free loop ends of the strap section 208.

As further illustrated in FIGS. 1 to 2C, the resistance module 102 further includes the adjusting member 203, which functions to adjust the length of the overall resistance module 102. The adjusting member 203 includes a conventional buckle 214 (e.g., a cam buckle) that is used to adjust and fix the length of the adjusting member 203 to any desired length to thereby vary the length of the overall resistance module 102. The adjusting member strap 218 includes marking 207 for measured and equal adjustment in length of the one or more resistance modules 102*a/b*.

The buckle 214 has a first end connected to the transversally oriented loop 212 of control member 201, with a second end of the buckle 214 for receiving a free, adjusting end of the adjusting member strap 218, looping through the buckle 214 to form a transversally oriented loop 216. The free, adjusting end of the adjusting member strap 218 is passed through a first elastic sleeve 224 and connected via a stitching to one interior lateral wall of a second elastic sleeve 226 (with the opposing interior wall of the second elastic sleeve 226 free). Therefore, as the second elastic sleeve 226 (with the connected free end of the adjusting member strap 218) is moved towards or away from the buckle 214, the length of the adjusting member strap 218 shortens or lengthens. That is, the second elastic sleeve 226 may be moved longitudinally along the length of the adjusting member 203 to any position (including marking 207) to increase or decrease the adjusting member length (with excess strap passing through the loop 216). It should be noted that the first elastic sleeve 224 may also be moved longitudinally along the length of the adjusting member 203 to appropriately tuck-in any excess slacking portion of the adjusting member strap 218. A second distal end 209 of the adjusting member 203 of the resistance module 102 is comprised of a transversally oriented stitched loop 220, which is connected to an end interlocking mechanism 222, a non-limiting example of which may include carabineer.

As best illustrated in FIG. 2C, one or more resistance module 102 may be used in combination for different types of exercise (detailed below). As mentioned above, a control member 201 includes a transversally oriented, laterally positioned loop 210, which may be used for coupling with another control member 201. That is, if a combination of two resistance modules 102*a* and 102*b* are used, then control member 201*a* of the resistance module 102*a* may be coupled with another control member 201*b* of of the second resistance module 102*b* by a stabilizer 108, a non-limiting, example of which may be a carabineer. The stabilizer 108 is used to provide synchronized motion of one or more resistance module 102 in relation to one or more strengthening module 104 during exercise. As further detailed below, the stabilizer 108 may also be used to couple together two strengthening modules 104*a/b* rather than two resistance modules 102*a/b*.

Figure 3A:
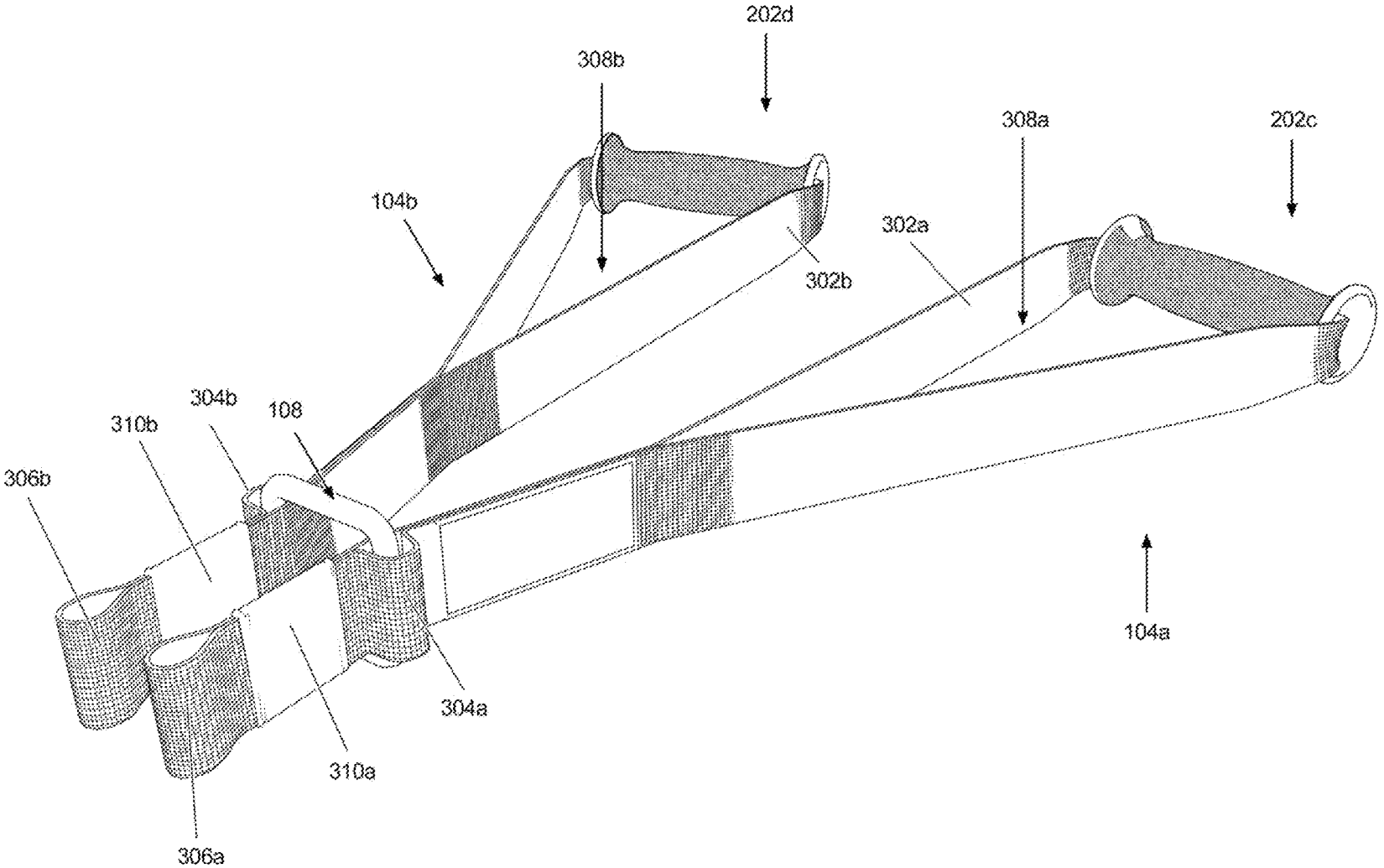
FIGS. 3A and 3B are non-limiting, exemplary illustrations detailing strengthening modules of the exercise device shown in FIG. 1 in accordance with the present invention.
Figure 3B:
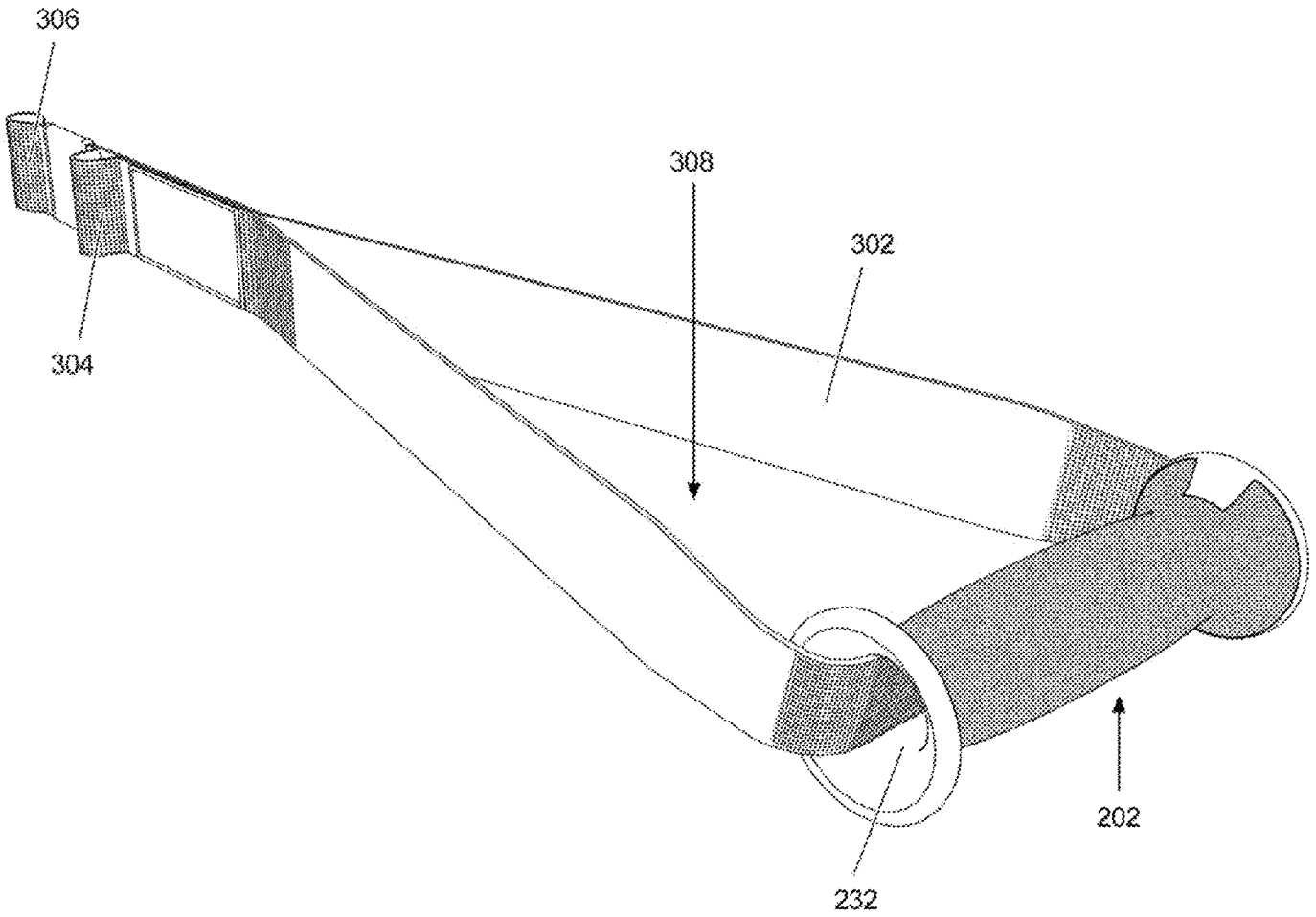

FIGS. 3A and 3B are non-limiting, exemplary illustrations detailing a strengthening module of the exercise device shown in FIG. 1 in accordance with the present invention. As illustrated in FIGS. 1 to 3B, the strengthening module 104 includes a strap 302 that is formed into a loop 308 with a slidably moving ergonomic handle 202 (with through-hole 232) thereon. The end of the strengthening module 104 includes a transversally oriented, laterally positioned loop 304 for connection with a secondary strengthening module 104 by the stabilizer 108. The strengthening module 104 further includes elastic sleeve 310 that is connected by stitching at one side, forming a free sleeve at an opposing side for receiving excess strap (slack), and a transversally oriented loop 306 for connection with the interlocking mechanism 222 of the resistance module 102. As best illustrated in FIG. 2B, the interlocking mechanism 222 is a carabineer that opens at one side thereof in the direction indicated by the arrow 211 and may be inserted within the loop 306.

Figure 4:
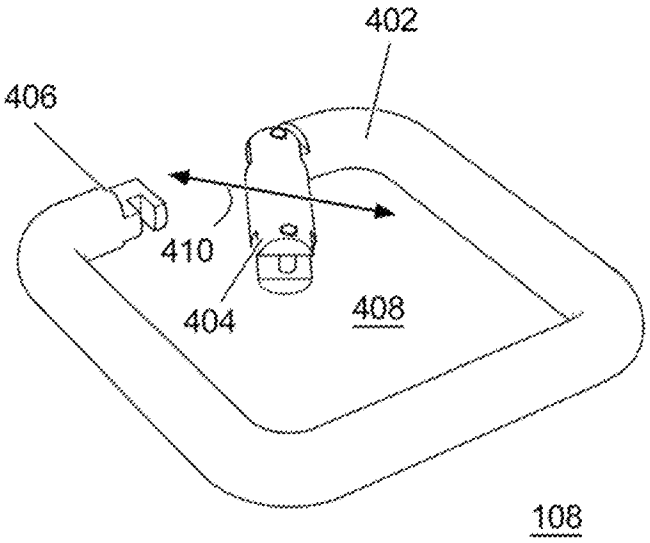
FIG. 4 is a non-limiting, exemplary illustration of a stabilizer in accordance with the present invention.
Figure 5A:
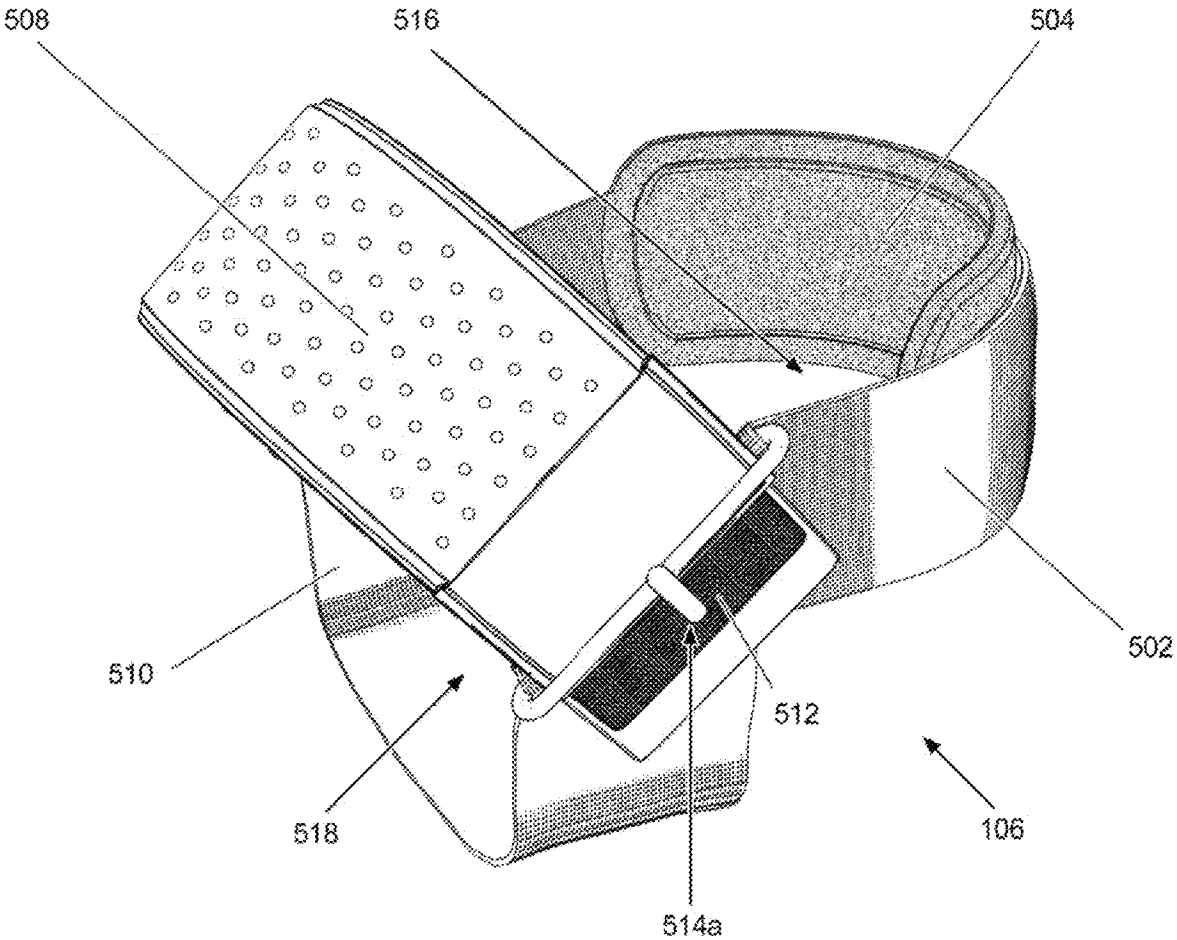
FIGS. 5A to 5D are non-limiting, exemplary illustrations of an ankle support in accordance with the present invention.
Figure 5B:
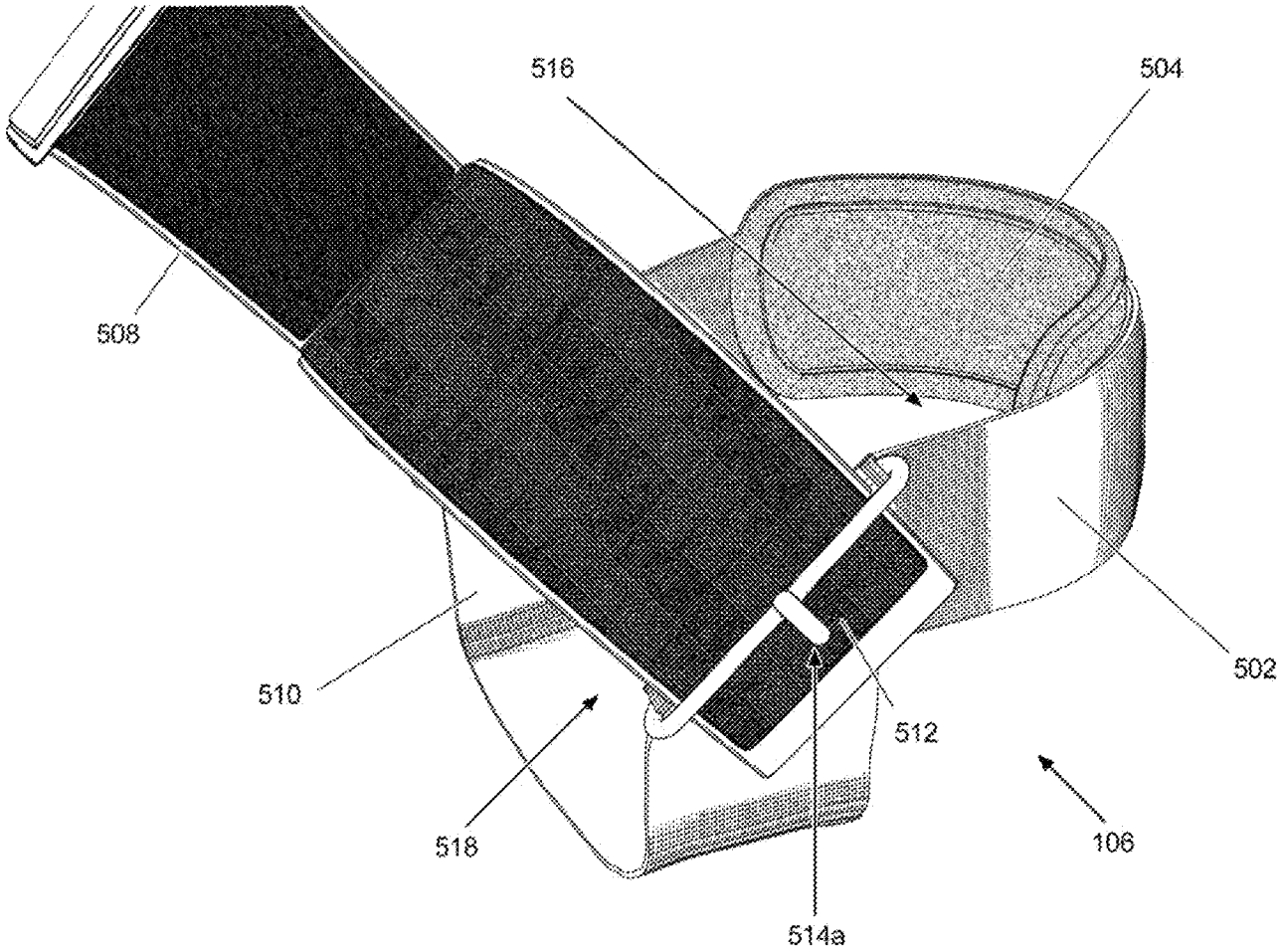
Figure 5C:
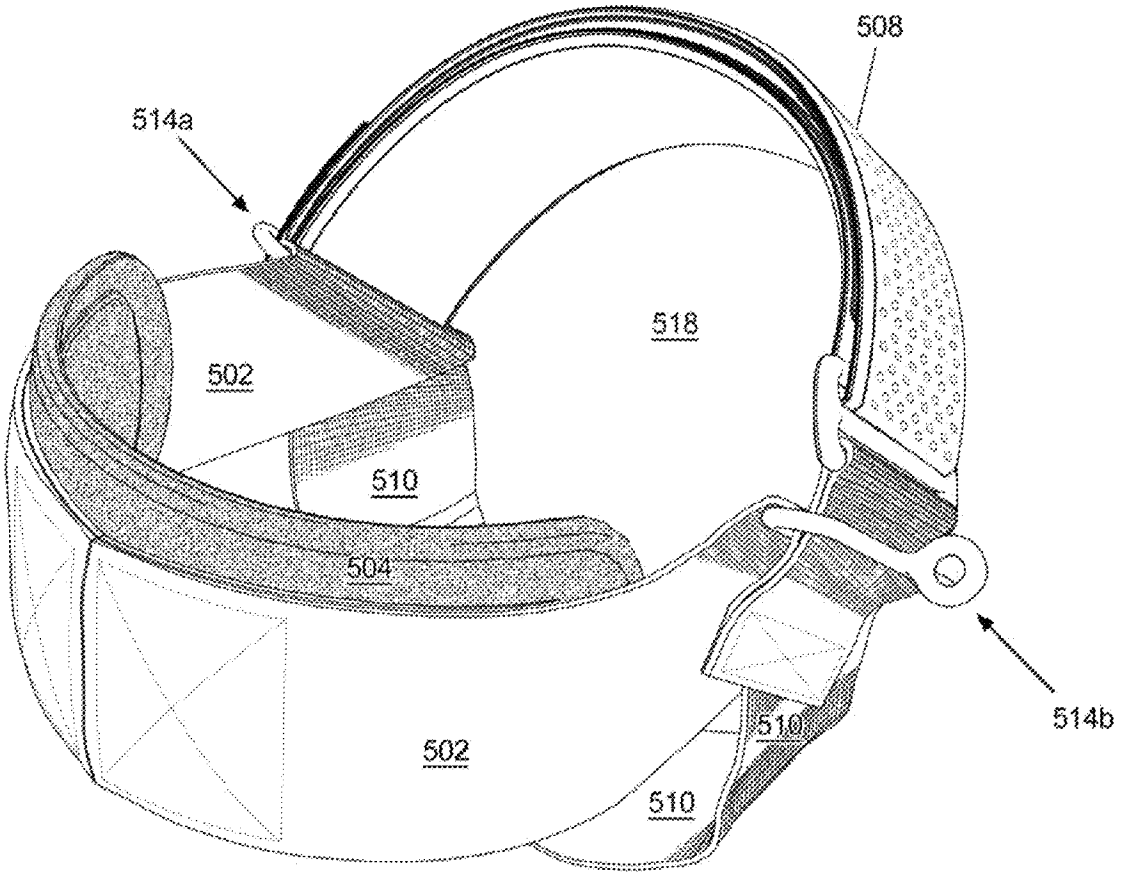
Figure 5D:
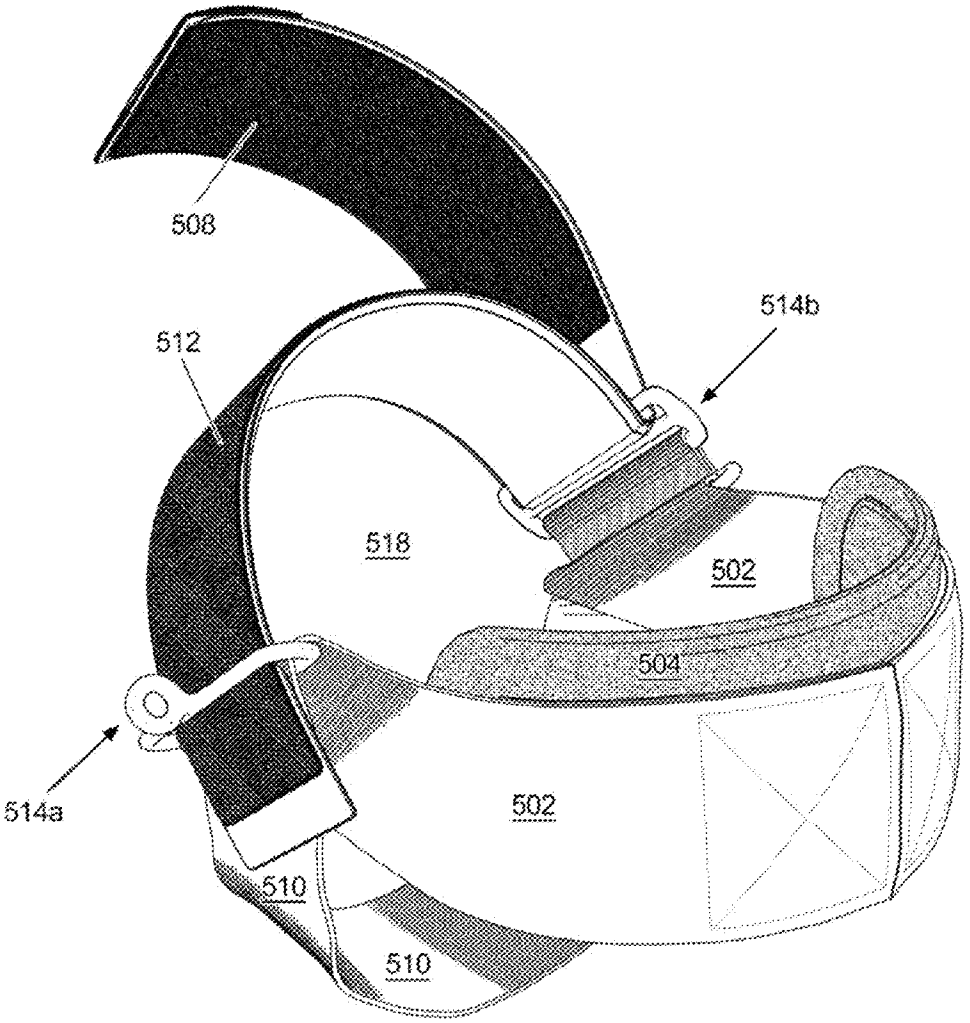

FIG. 4 is a non-limiting, exemplary illustration of a stabilizer in accordance with the present invention. As illustrated in FIGS. 1 to 4, the stabilizer is comprised of substantially square configuration with smooth corner edges 402 with a side 404 that is hinged at one end 406, which opens towards the interior 408 in the direction illustrated by the arrow 410. As the side 404 moves along path 410, the stabilizer is easily inserted onto one of the sets of the transversally oriented, laterally positioned loop sets 304*a* and 304*b* of the strengthening module 104*a/b* (FIG. 3A) or, alternatively, the transversally oriented, laterally positioned loop sets 210*a* and 210*b* of the resistance module 102*a/b* (FIG. 2C). As more apparent below, for exercises where the strengthening modules 104*a/b* must be as far apart as possible, the stabilizer 108 is associated with the resistance modules 102*a/b* (FIG. 2C). For exercises where the strengthening modules 104*a/b* must be together, the stabilizer 108 is associated with the strengthening module 104*a/b* (FIG. 3A). In other words, the association of the stabilizer 108 depends on the exercise and its related motion in relation to the strengthening modules 104*a/b*. It should be noted that the user of the stabilizer 108 is optional, but preferred.

As mentioned above, the exercise device of the present invention provides for a full upper and lower body workout and hence, it includes an ankle support that may be used for lower body workouts. FIGS. 5A to 5D are non-limiting, exemplary illustrations of an ankle support in accordance with the present invention. As illustrated in FIGS. 1 to 5D, the exercise device 100 includes an ankle support 106 that couples with the resistance module 102. The ankle support 106 includes a first and second attachment mechanisms 514*a/b* that hook onto a respective first and second interlocking mechanism 222*a/b* of the resistance modules 102*a/b*. As best illustrated in FIG. 2B, the interlocking mechanism 222 is a carabineer that opens at one side thereof in the direction indicated by the arrow 211 and may hook onto the attachment mechanism 514 of the ankle support 106. Each of the attachment mechanisms 514*a/b* on both sides for the ankle support 106 may be connected to the respective resistance module 102*a/b*.

As further illustrated, the ankle support 106 further includes an adjusting mechanisms 508/512 (e.g., such as Velcro belts) that enable adjusting the ankle support 106 for different size feet with any extra slack from the adjustment mechanism 508/512 tucked into the attachment mechanism 514 as illustrated. The ankle support 106 further provides a cushion support 504 connected to a mid portion of a back support 502. The heel of the foot is inserted through the opening 516, with the front portion of the foot (including the toes passing through the opening 518), with the bottom of the foot supported by the foot support 510.

Figure 6A:
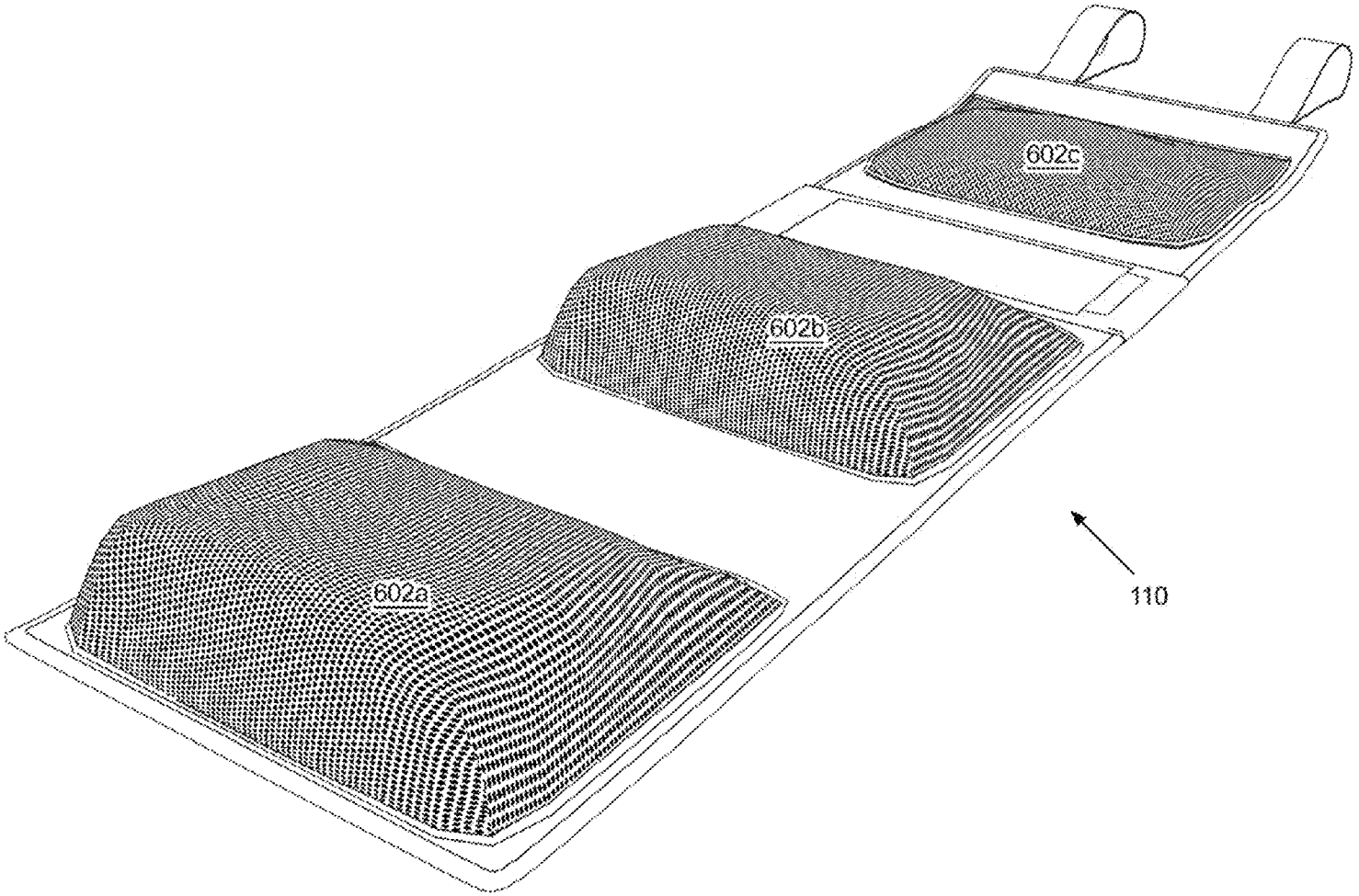
FIGS. 6A to 6C are non-limiting, exemplary illustrations of a storage and carrying case in accordance with the present invention.
Figure 6B:
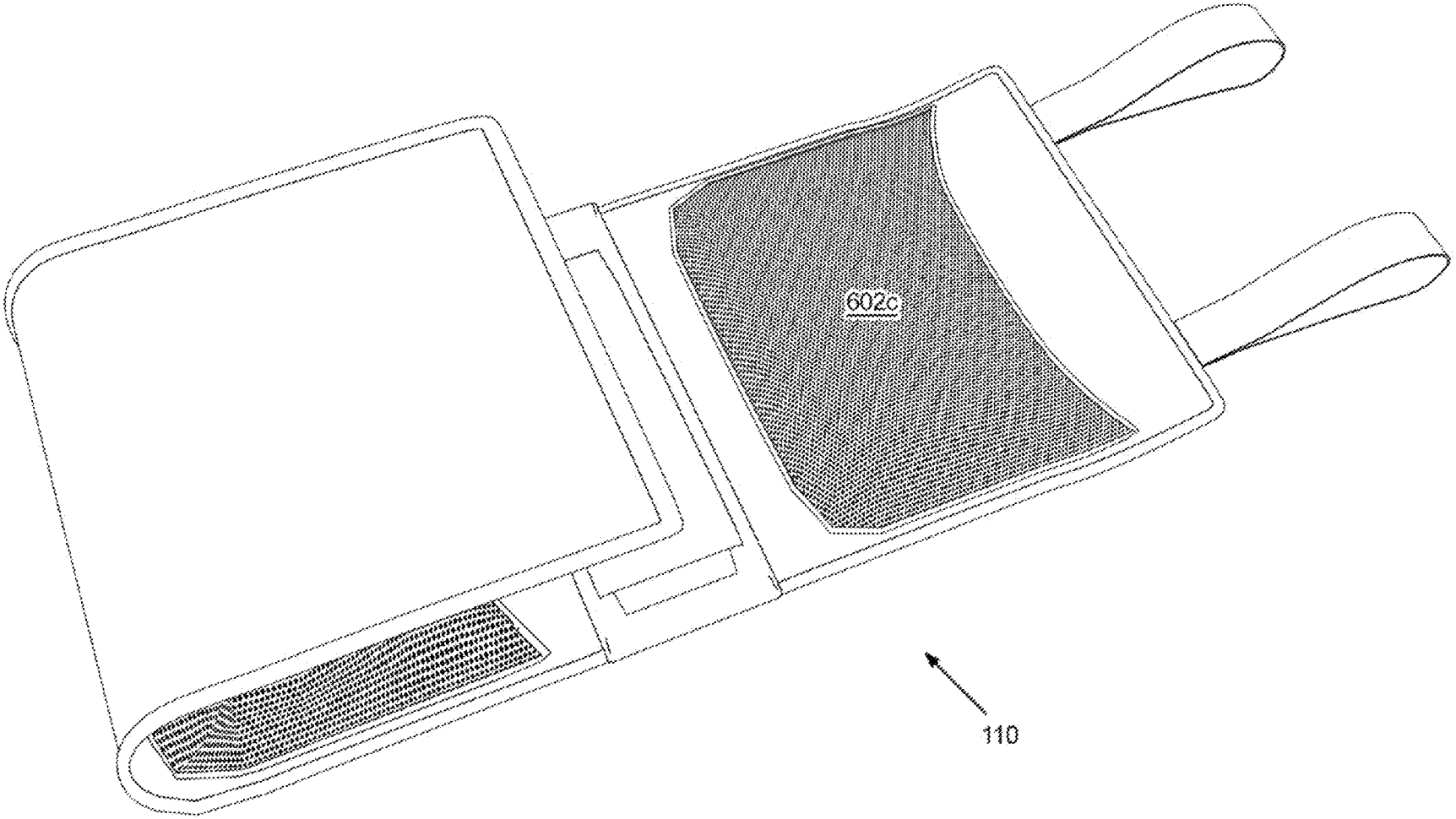
Figure 6C:
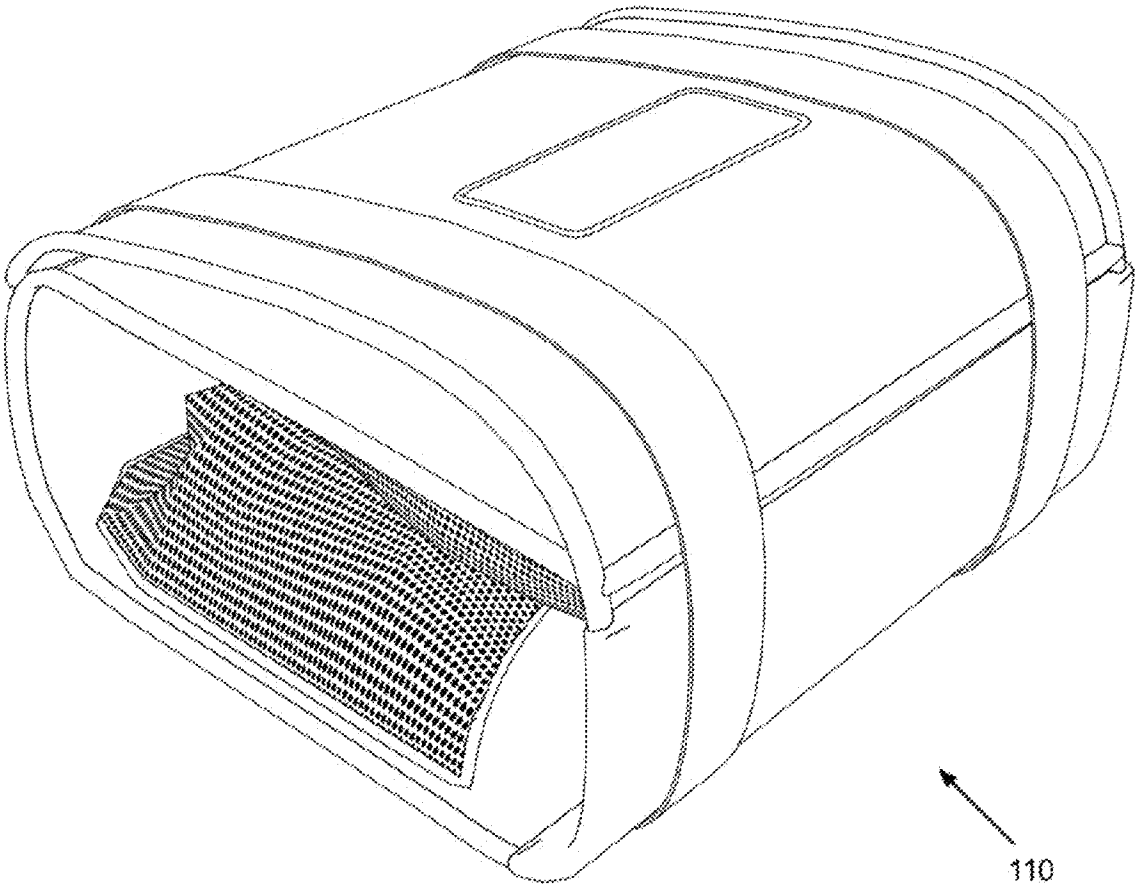

As further mentioned above, the exercise device of the present invention provides a portable and compact storage and carrying case. FIGS. 6A to 6C are non-limiting, exemplary illustrations of a storage and carrying case in accordance with the present invention. As illustrated in FIGS. 1 to 6C, a portable, foldable, compact storage and carrying case 110 is provided that includes several pockets 602 for storage of the various components of the exercise device 100, with the storage and carrying case 110 illustrated as progressively folded (FIGS. 6A to 6C) into a very compact form (FIG. 6C).

Figure 7A:
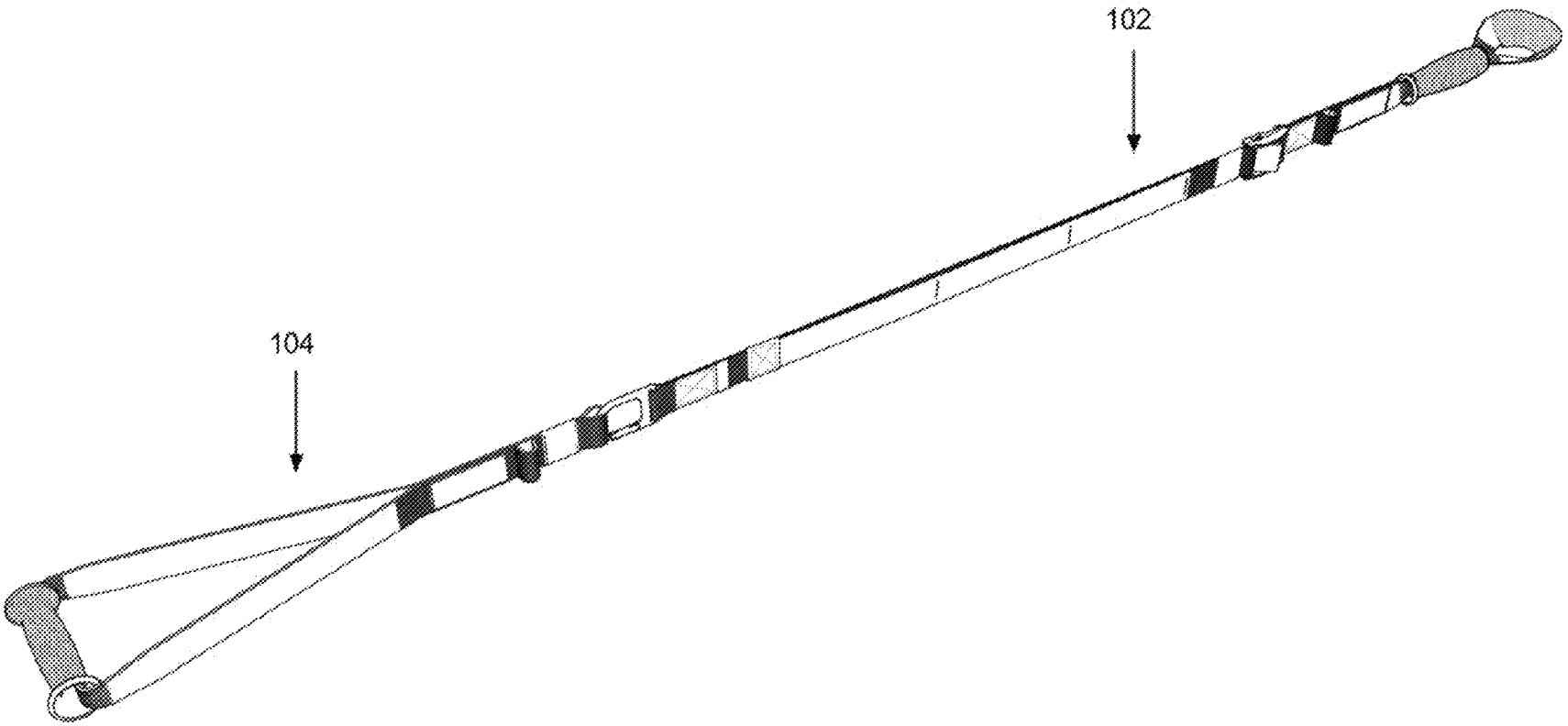
FIGS. 7A to 7D are non-limiting exemplary illustrations of a fully assembled exercise device shown in FIG. 1 in accordance with the present invention.
Figures 1, 7B:
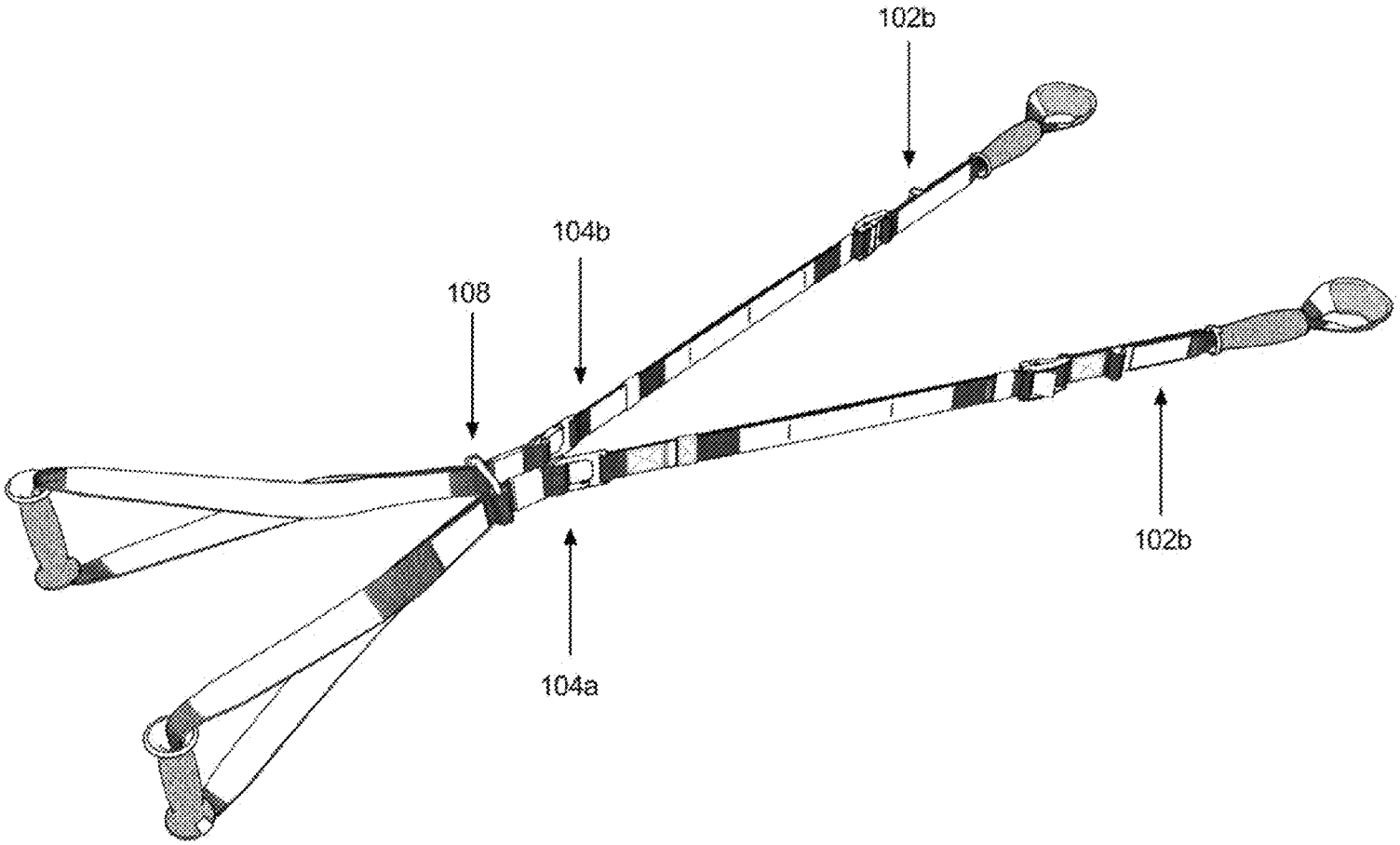
Figures 2, 7B:
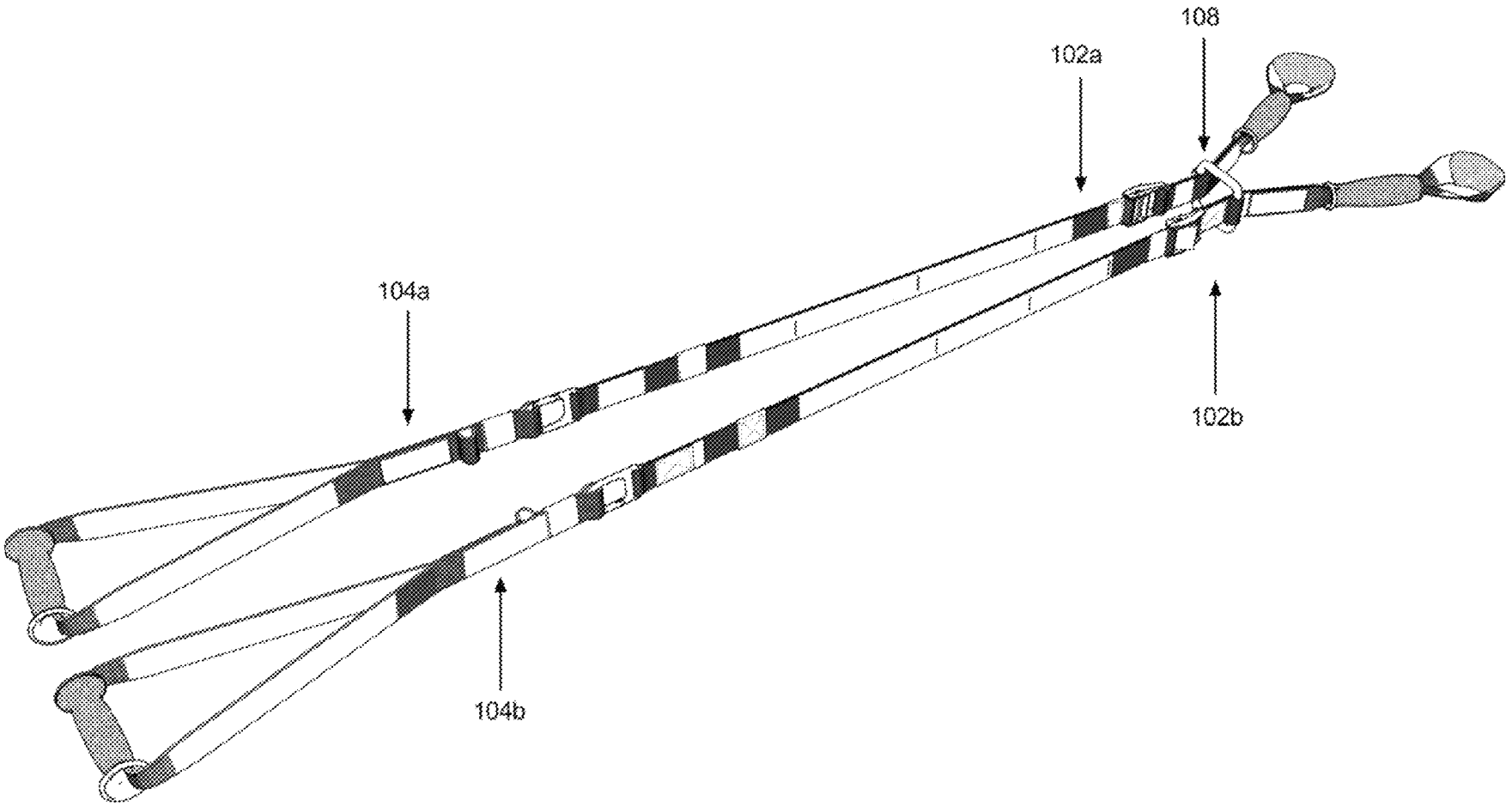
Figure 7C:
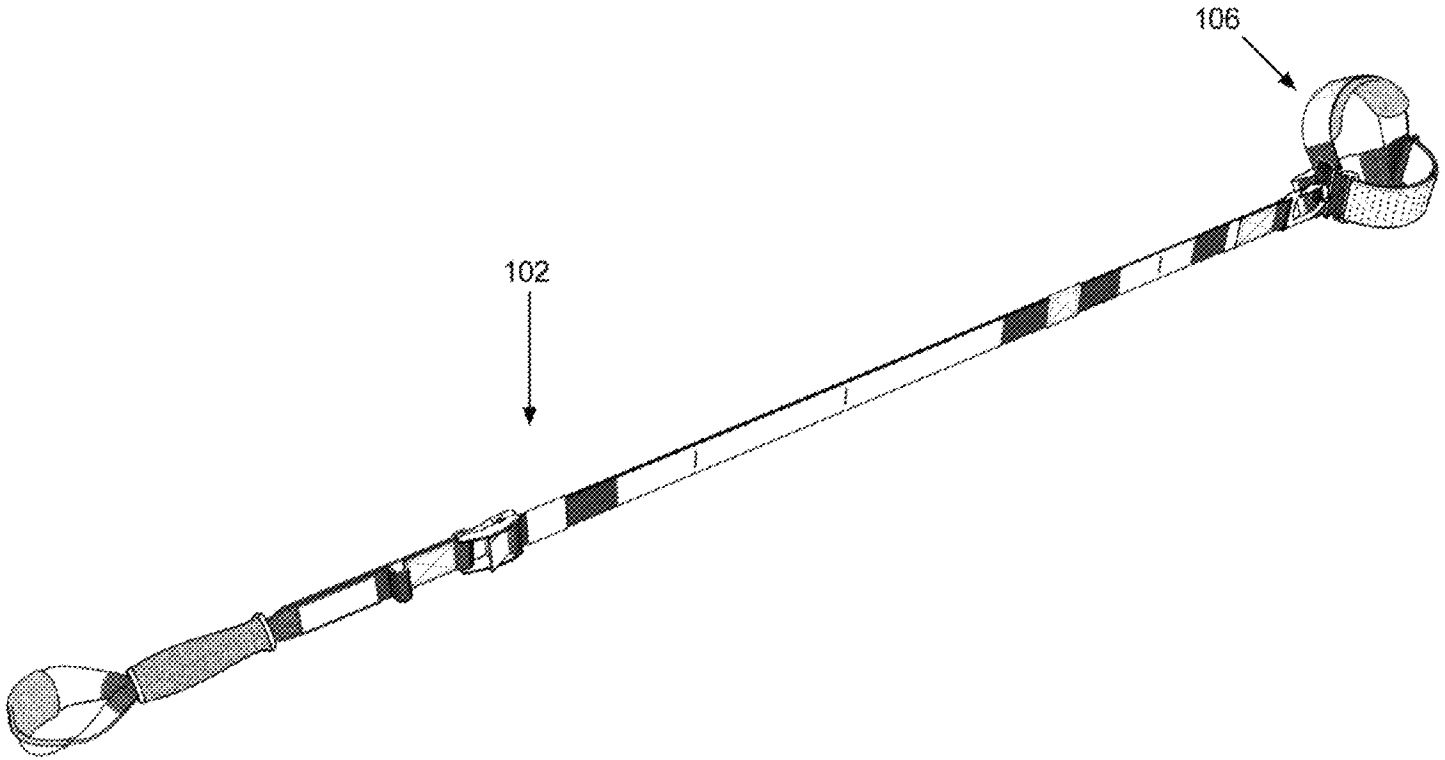
Figure 7D:
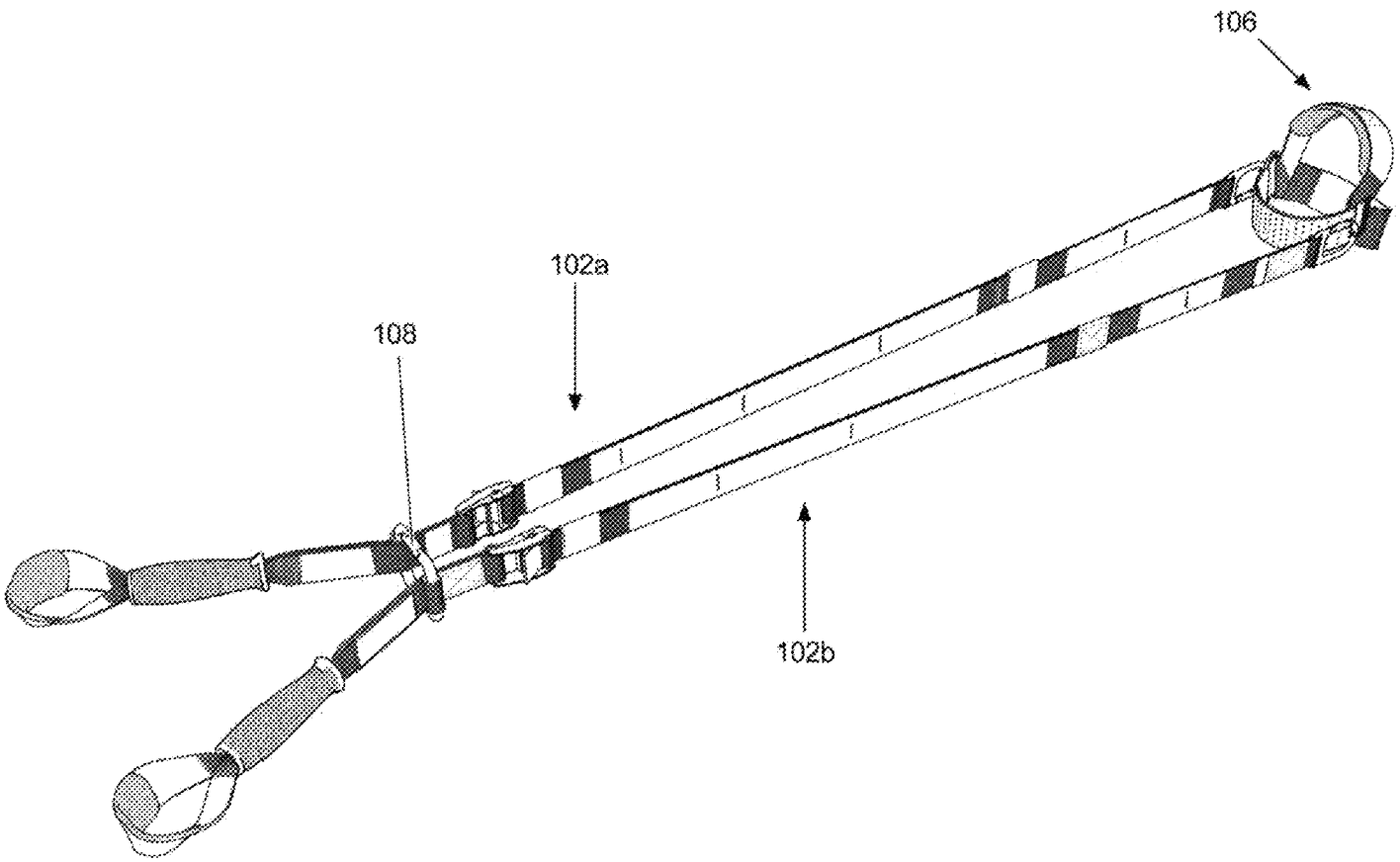

FIGS. 7A to 7D are non-limiting exemplary illustrations of a fully assembled exercise device shown in FIG. 1 in accordance with the present invention. FIG. 7A is a non-limiting exemplary illustration of a single resistance module 102 coupled with a single strengthening module 104. FIGS. 7B-1 and 7B-2 are a non-limiting, exemplary illustration of a dual resistance modules 102*a* and 102*b* coupled with dual strengthening modules 104*a* and 104*b* using a stabilizer 108 associated with the strengthening modules 104*a* and 104*b* (FIG. 7B-1) and resistance modules 102*a* and 102*b* (FIG. 7B-2). FIG. 7C is a non-limiting exemplary illustration of a single resistance module 102 coupled with the ankle support 106. FIG. 7D is a non-limiting, exemplary illustration of a dual resistance modules 102*a* and 102*b* coupled with dual strengthening modules 104*a* and 104*b* using a stabilizer 108 associated with the control member 201*a* and 201*b* of the respective resistance modules 102*a* and 102*b*.

FIGS. 8A-1 to 8F-2 are non-limiting, non-exhaustive, merely exemplary illustrations of a few upper and lower body exercise routines using the exercise device shown in FIGS. 1 to 7D in accordance with the present invention. As illustrated in FIGS. 1 to 8G-2, the present invention allows for a collaborative exercises by providing independently controlled and continuously changing resistance and resistance-vector by one individual R (for Resistance provider) while simultaneously providing independently controlled and continuously adaptive responsive counteracting force and counteracting force-vector by another individual CF (for Counteracting Force provider) to the continuously changing resistance and resistance vector provided by the individual R.

As apparent from FIGS. 8A-1 to 8F-2, a maximum range of resistance using the collaborative exercise device 100 of the present invention for the individual CF is defined by his or her body weight, the body weight of the individual R, or both as a result of one of an application of the resistance (by individual R) and a responding application of the counteracting force (by individual CF) to the provided resistance.

As further illustrated, the independent application of resistance and resistance-vector by individual R may adaptively change in response to any potential unbalanced counteracting force and counteracting force-vector of a symmetrical set of muscles of the individual CF. That is, the individual R may stop, increase, or decrease, and or change the angle, orientation, or direction of resistance and resistance-vector based on the felt response (feedback) from any potential unbalanced counteracting force and counteracting force-vector from the individual CF.

As illustrated in FIGS. 8A-1 to 8F-2, the collaborative exercise device 100 via one or more resistance modules 102*a/b* is used by the individual R, which provides independently controlled and continuously changing resistance and resistance-vector to the individual CF. As illustrated, when using the exercise device 100, a single resistance module 102 or a combination of two resistance modules 102*a* and 102*b* may be used. The individual R may insert their left, right, or left and right hand into the respective one or both loops 238*a/b* of the first ends 204*a/b*, and grip the ergonomic handle 202*a/b* of the control members 201*a/b* of the resistance module 102*a/b*, and controllably pull on the resistance module 102*a/b* to fully and independently control and continuously change the resistance and resistance-vector of an exercise routine during the execution of the exercise. If both resistance modules 102*a* and 102*b* (which of course include the control member 201 and the adjusting member 203 as illustrated) are used, then the individual R may easily pull in different directions and with more strength on one of the resistance module 102*a* or 102*b* or both to thereby vary resistance and resistance-vector of an exercise routine for the individual CF or any specific muscle groups. Simultaneously, the individual CF provides independently controlled and continuously adaptive responsive counteracting force and counteracting force-vector to the continuously changing resistance and resistance vector provided by the individual R. The counteracting force and counteracting force vector may be provided by upper body (via the strengthening module 104) or lower body (via the ankle support 106 or the strengthening module 104). When using exercise device 100 in a dual mode (using both resistance modules 102*a* and 102*b*), if desired, the length of the adjusting members 203*a* and 203*b* may be set to equal or a measured difference using the markings 207*a/b* on the adjusting member 203*a/b*. The use of the exercise device 100 in dual mode with measured differences in the length of the resistance modules 102*a* and 102*b* will obviously provide different resistances for the left verses the right sides of the body in terms of both resistance and the responsive counteracting force thereof experienced by the individual R and individual CF.

Figures 1, 8A:
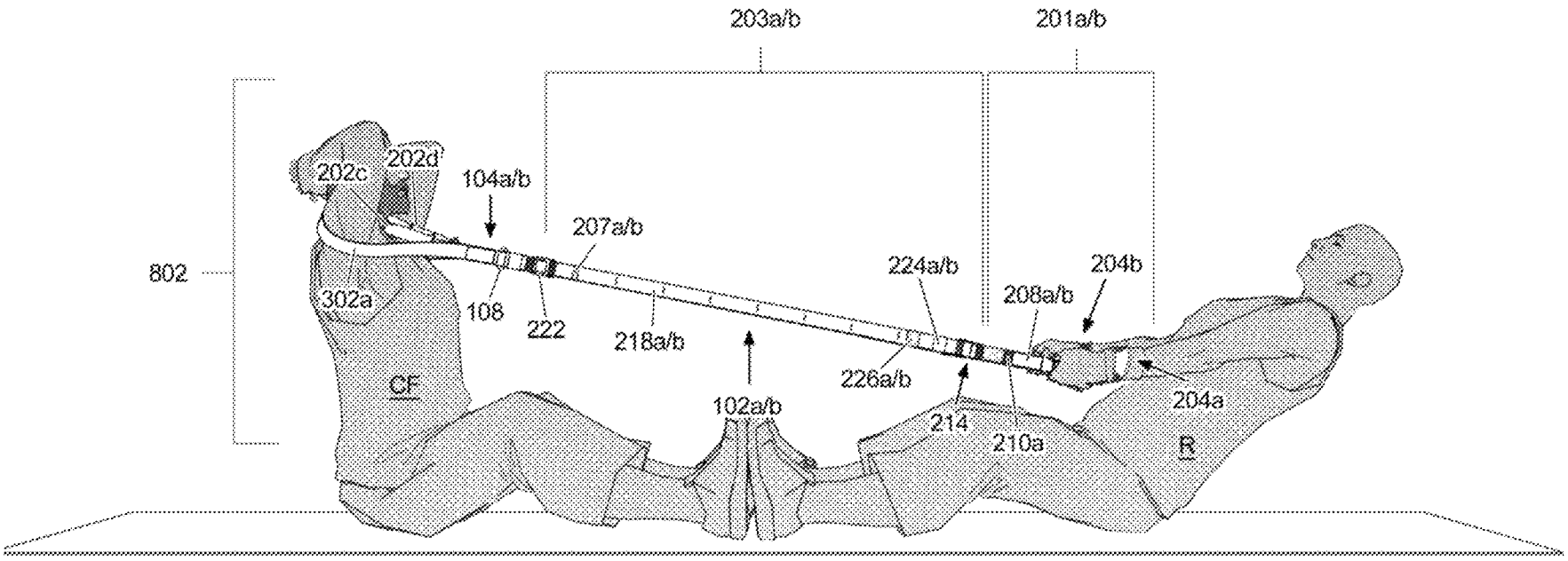
Figures 2, 8A:
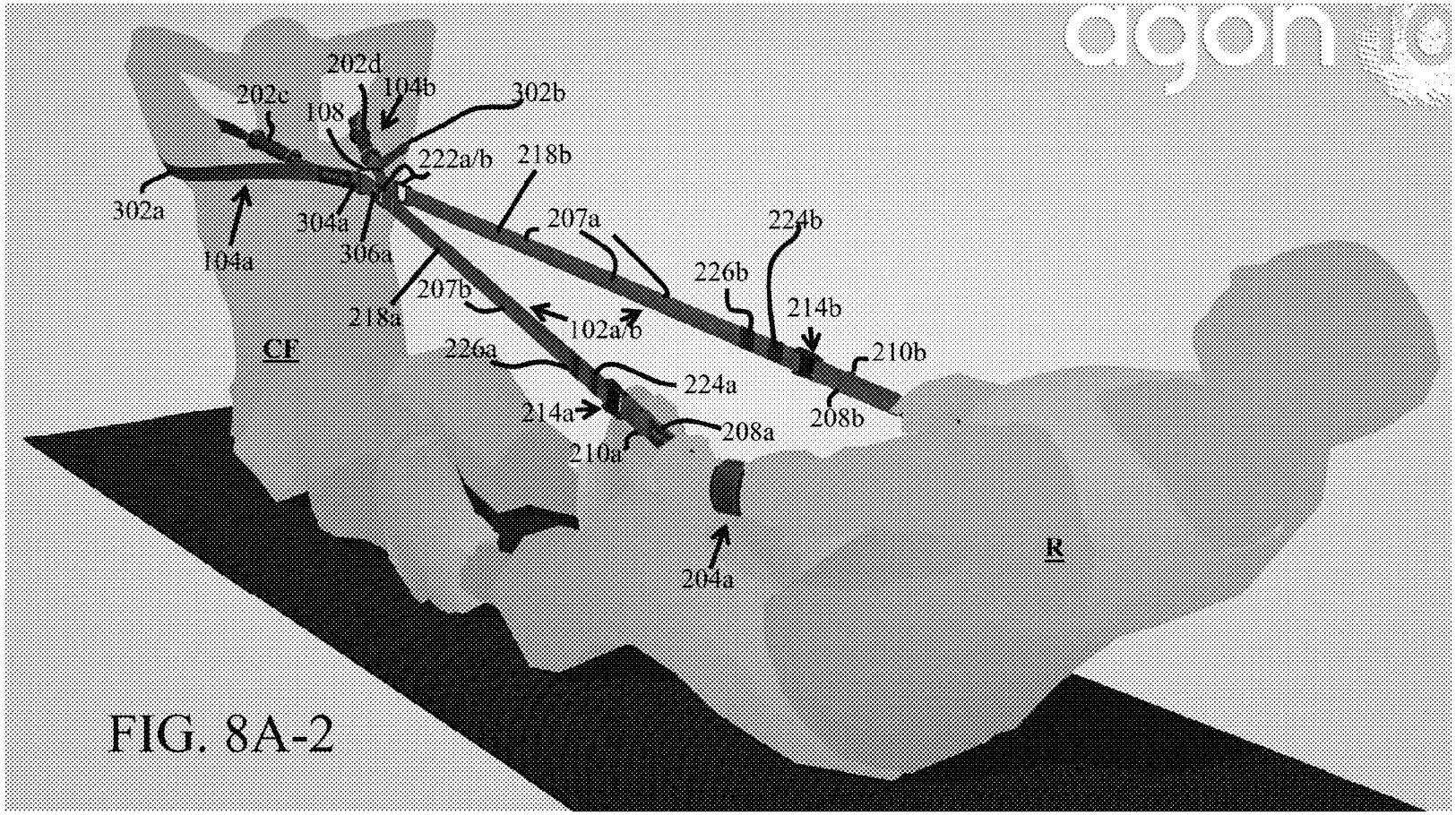

As a specific example, FIGS. 8A-1 and 8A-2 are illustrations of an exercise routine for abdominal muscles that use the exercise device 100 of the present invention, which is not possible by conventional exercise devices that use adjustable inelastic straps that require a fixed anchor. As illustrated, the exercise device 100 is used in dual mode of operation for this particular routine where resistance modules 102*a* and 102*b* and strengthening modules 104*a* and 104*b* are used.

In this exercise routine, the individual R firmly holds the control members 201*a* and 201*b* of the resistance module 102*a* and 102*b* as described above while the individual CF inserts his or her left and right arms within the loops 308*a/b* of the strap 302*a/b* of the strengthening modules 104*a* and 104*b*. It should be noted that for this exercise routing, the individual CF has moved the handle grips 202*c/d* to a section of the strap 302*a/b* for comfort since handles 202*c/d* are not used for this particular exercise routine.

With the exercise routing shown in FIGS. 8A-1 and 8A-2, the individual CF moves his or her upper body 802 from the illustrated vertical position to a flat, horizontal position and back to the illustrated vertical position repeatedly to thereby exercise the abdominal muscles, which would not be possible with conventional adjustable inelastic straps that require an anchor. Simultaneously, the non-stationary, continuously moving individual R varies the resistance experienced by the individual CF in terms of magnitude and direction during the exercise. As best seen in FIG. 8A-2, the individual R may vary the direction and magnitude of the pull, including varying the pull more on one of the left or the right side and hence, vary the pull (hence, the overall resistance) experienced by the individual CF on his or her left side, right side, or both right and left sides, providing a lateral varying and linearly varying resistances for the abdominal exercise routine. With this particular exercise, the more pull is provided (regardless of direction) by the individual R, the less resistance is experienced by the individual CF.

With the present invention, the individual R may easily provide an adaptive response in terms of resistance and resistance vector to compensate for unbalanced strengths between symmetrical muscle groups (e.g., right-side shoulders/legs verses the left side shoulder/legs muscle groups of the exercising individual CF for the same, identical exercise routine). Hence, if for example, the individual R experiences that the individual CF is constantly tilting (or twisting) the right shoulder to the left and pushing more with the right or left leg to move from the horizontal to the illustrated vertical position, then the individual R may pull stronger on right or left resistance module 102*a* or 102*b* to compensate for the unbalanced right-left side strengths of the individual CF. In other words, the individual R may allow the right side of the individual CF to actually experience more resistance to eventually equalize the right-left side strengths of the individual CF through exercise. It should be noted that the use of the illustrated stabilizer 108 associated with one of the strengthening modules 104*a* and 104*b* and that of the resistance modules 102*a* and 102*b* is optional for this and all other exercise routines, but preferred.

With the exercise device 100 of the present invention, the resistance and resistance-vectors may be varied to maximize concentric, eccentric, and isometric contractions of the muscle during muscle's full range of motion while exercising. In other words, the exercise device 100 may be used to isolate muscle contractions in terms of concentric, eccentric, and isometric contractions, with application of varying resistances and resistance vectors for the full range of motion of the muscle. In the non-limiting exemplary exercise routine that is shown in FIGS. 8A-1 and 8A-2, the abdominal muscles of the individual CF when moving from the illustrated vertical position to a horizontal position experience maximum eccentric contractions, and when moving from the horizontal position to the illustrated vertical position experience maximum concentric contractions. If the individual CF decides to maintain the upper body 802 without moving in mid-way between the vertical and horizontal positions, then the abdominal muscles would experience isometric contractions. Accordingly, with the present invention, the exercise device 100 enables the individual R to vary application of resistance and resistance-vectors experienced by the individual CF for specific parts of the exercise routine to isolate and maximize concentric, eccentric, and isometric contractions of the muscle during a muscle's full range of motion while exercising. For example, the individual R may increase the pull (which means less resistance experienced by the individual CF) during concentric muscle contraction (when individual CF is moving from horizontal to the illustrated vertical position). This means an easier workout experience for the individual CF during concentric contraction of the muscle. On the other hand, the individual R may provide zero resistance (no pull by the individual R), when the individual CF moves from the illustrated vertical to the horizontal position, strongly working the abdominal muscles during eccentric contractions to thereby isolate and maximize eccentric contraction of the muscle during a muscle's full range of motion while exercising. It should be noted that the individual R may easily and quick stop the exercise routine by full strength pull on the resistance modules 102*a/b* (when the individual CF is in vertical position) and not allow the individual CF to move or, not pull at all when the individual CF is in horizontal position in cases of incorrect application of resistance or counteracting force to thereby stop potential injuries.

Figures 1, 8B:
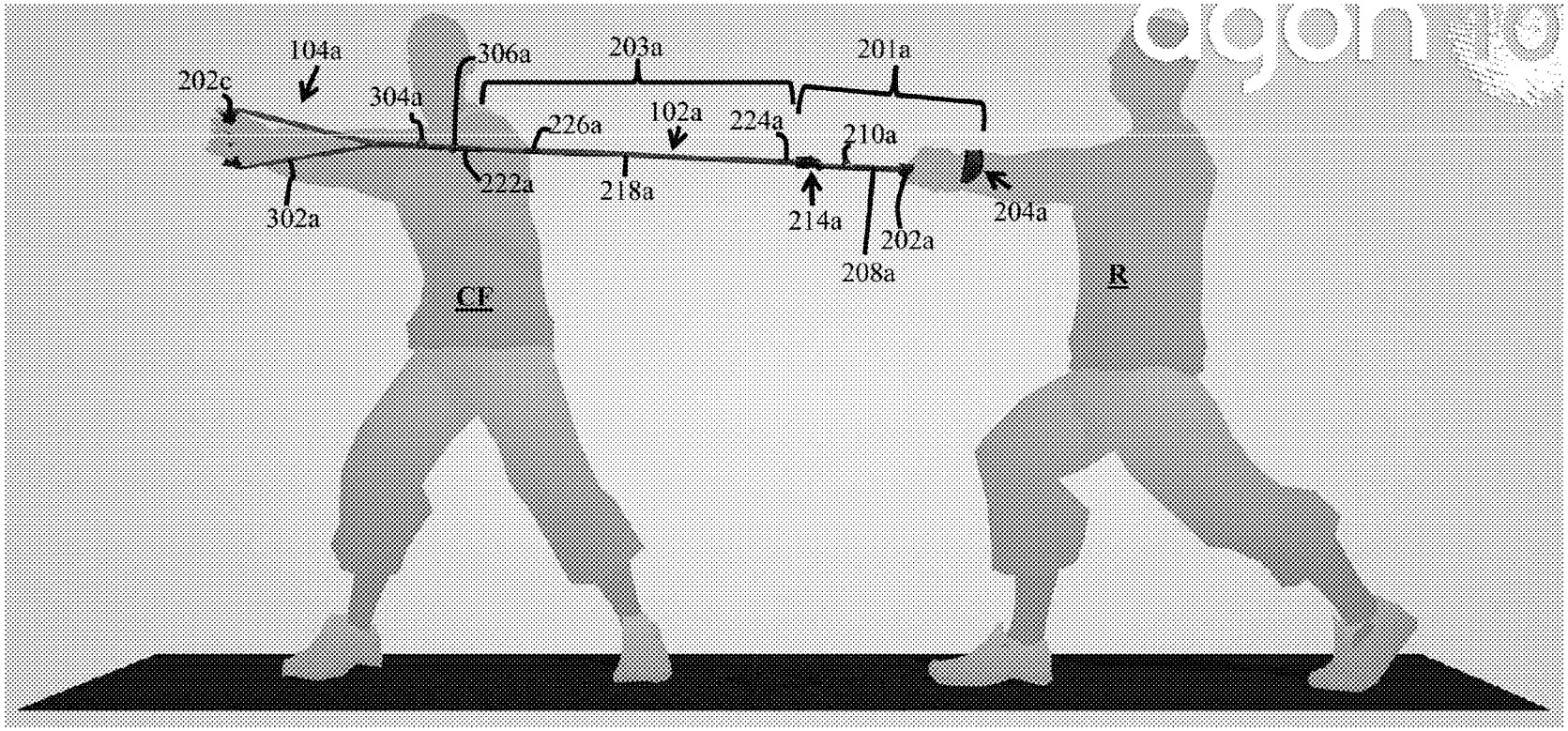
Figures 2, 8B:
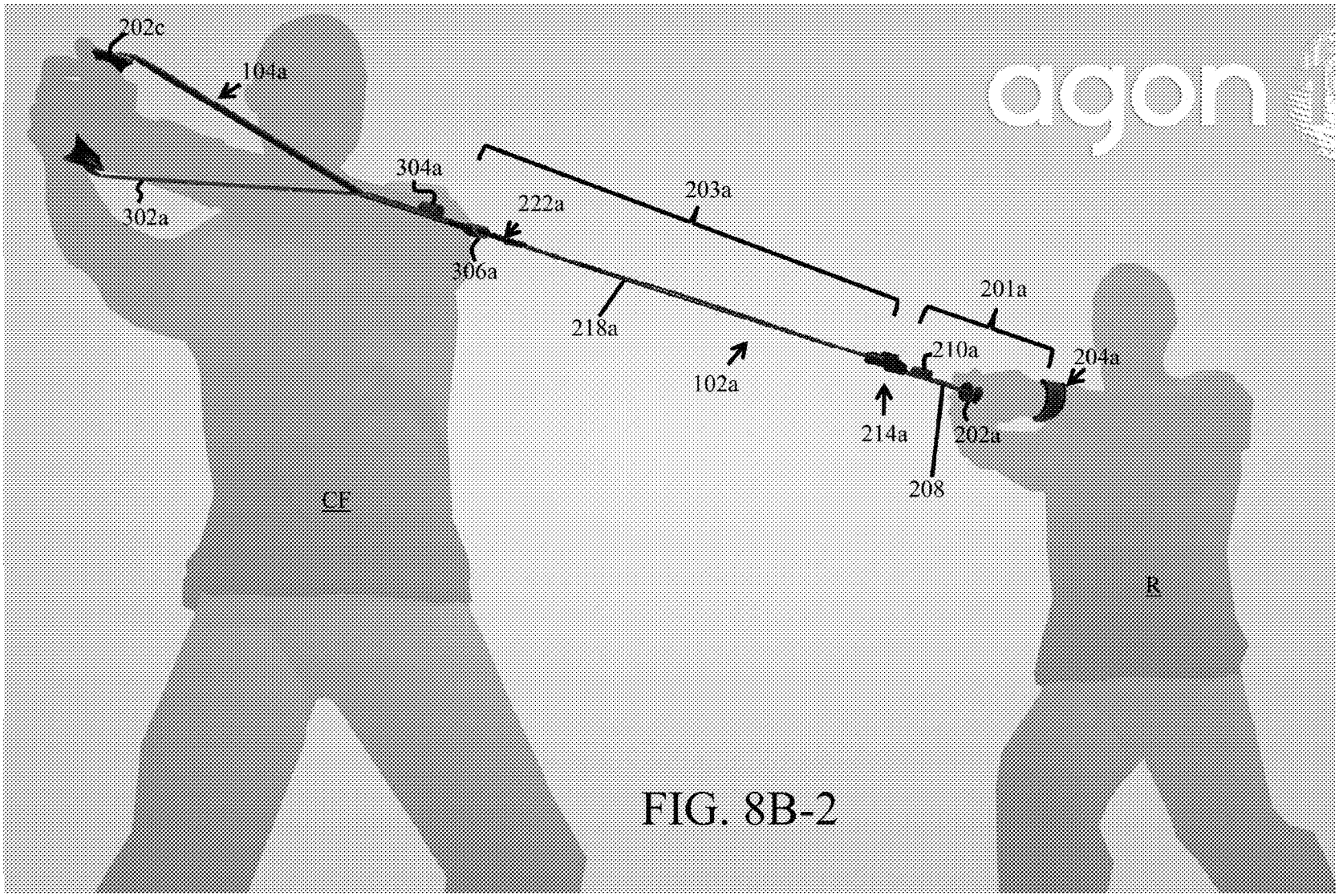
Figures 3, 8B:
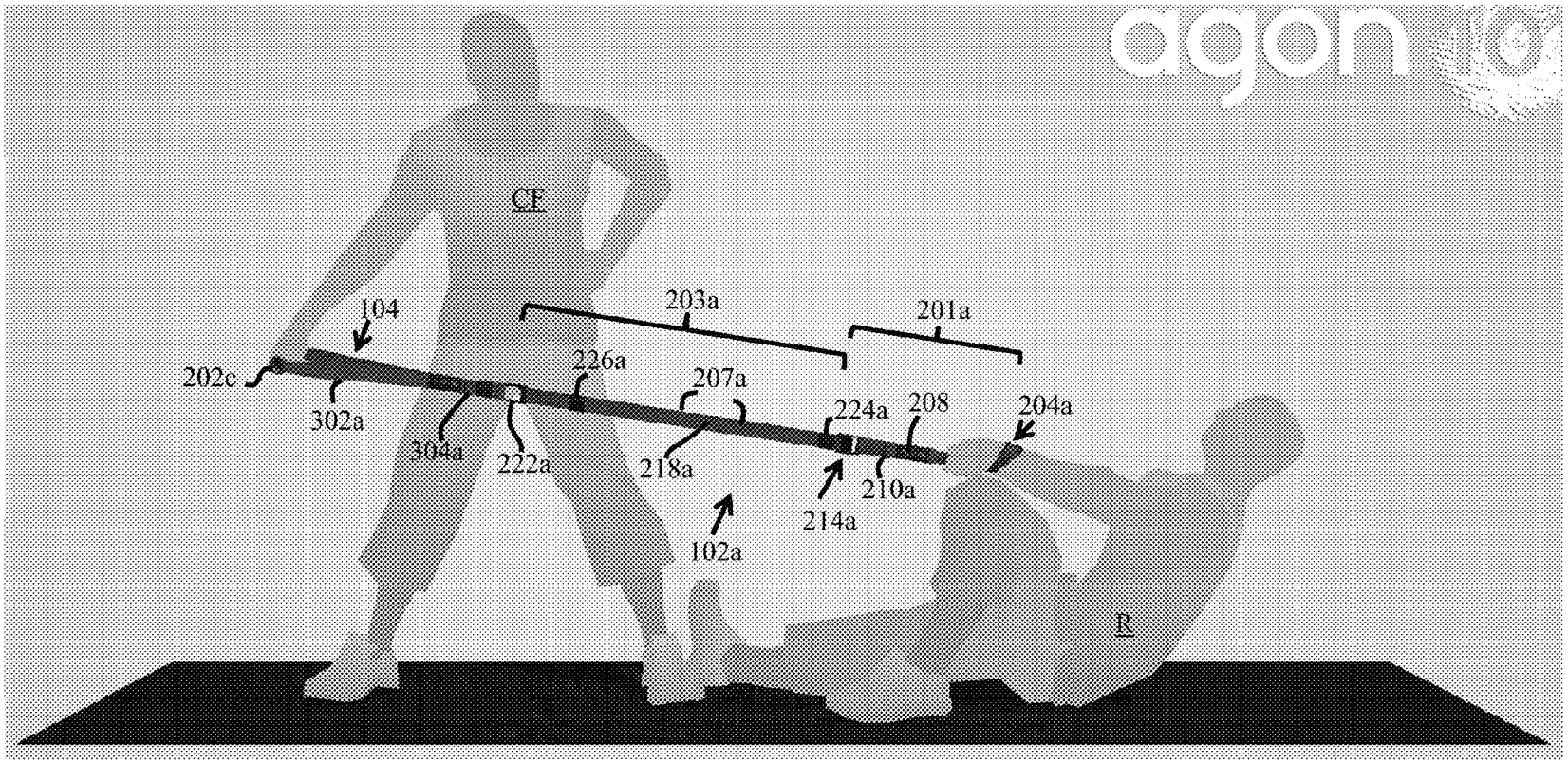
Figures 4, 8B:
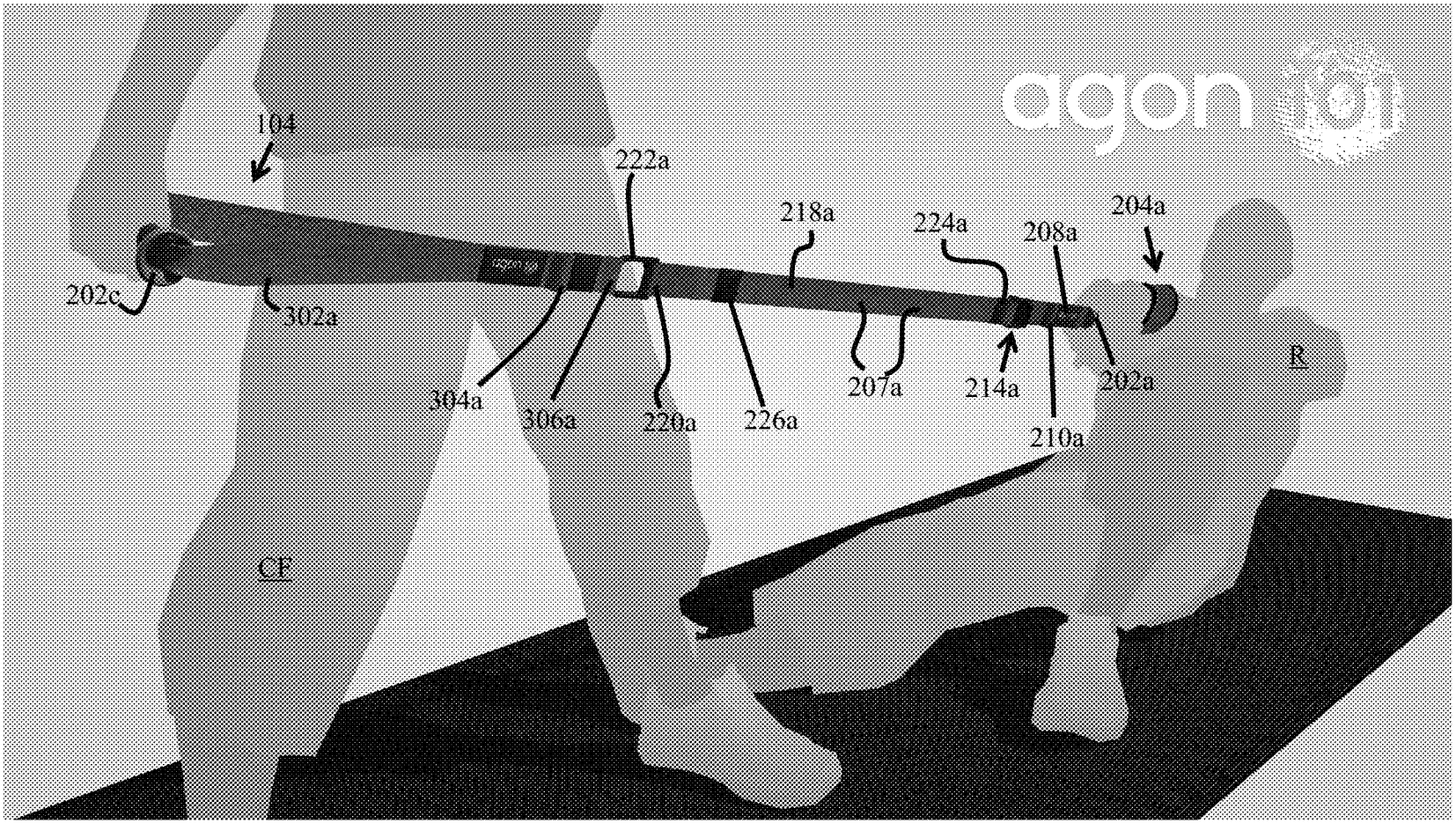

FIGS. 8B-1 and 8B-2 are non-limiting, exemplary illustrations of exercise routines manly for core muscles using the exercise device shown in FIGS. 1 to 8G-2 in accordance with the present invention. As illustrated, the exercise device 100 is used in a single mode of operation for these particular routines where single resistance module 102 and single strengthening module 104 are used.

As with other exercise routines, in these exercise routines, the individual R firmly holds the control member 201 of the resistance module 102 as described above while the individual CF firmly grips the handles 202*c* of the strengthening modules 104. With the exercise routing shown in FIGS. 8B-1 and 8B-2, the individual CF twists his or her upper body 802 while maintaining the arms aligned with the shoulders and the head as illustrated. With the exercise routing shown in FIGS. 8B-3 and 8B-4, the individual CF simply moves his or her arm up to for exercise the shoulders (arm lateral raises for shoulder exercises). Simultaneously, the non-stationary, continuously moving individual R (seating, standing, or moving around) varies the resistance experienced by the individual CF in terms of magnitude and direction during the exercise. As best seen in FIGS. 8B-2 and 8B-4, the individual R may vary the direction and magnitude of the pull, including varying the pull more on one of the left or the right side (or up or down or any direction) and hence, vary the overall resistance and resistance vector experienced by the individual CF. With these particular exercises, the more pull is provided (regardless of direction) by the individual R, the greater resistance is experienced by the individual CF.

With the present invention, the individual R may easily provide an adaptive response in terms of resistance and resistance vector to compensate for unbalanced strengths between symmetrical muscle groups (e.g., right-side arms/shoulders verses the left side arms/shoulder muscle groups of the exercising individual CF for the same, identical exercise routine). Hence, if for example, the individual R experiences that the individual CF has a weaker pull with the right arm/shoulder, then the individual R may balance and adapt the resistance and resistance vector to compensate for the unbalanced or weaker right arm/shoulder to maximize the muscular response of the individual CF. In other words, the individual R may allow both sides of the individual CF to work independently at the same level of resistance and resistance vector comparatively to their own potential to eventually increase strength and equalize the right-left side strengths of the individual CF through exercise.

In the non-limiting exemplary exercise routine that is shown in FIGS. 8B-1 to 8B-4, the upper body muscles of the individual CF when moving from the straight body position to the twisted position (as illustrated in FIG. 8B-2) or the arm moving away from the individual R (as shown in FIG. 8B-4) experience maximum concentric contractions, and when moving back to the straight (or untwisted) position (or down for FIG. 8B-4) the muscles experience eccentric contractions. Accordingly, with the present invention, the exercise device 100 enables the individual R to vary application of resistance and resistance-vectors experienced by the individual CF for specific parts of the exercise routine to isolate and maximize concentric, eccentric, and isometric contractions of the muscle during a muscle's full range of motion while exercising. For example, the individual R may increase the pull (which means increases resistance experienced by the individual CF) during concentric muscle contraction through the range of motion (when individual CF is moving from straight to the illustrated twisted position (FIG. 8B-2) or the arm is moving away from the individual R (FIG. 8B-4)). This means a more challenging workout experience for the individual CF during concentric contraction of the muscle. On the other hand, the individual R may provide even stronger resistance (more resistance by the individual R), when the individual CF moves back to the rest position, providing maximum work for the muscles during eccentric contractions to thereby isolate and maximize eccentric contraction of the muscle during a muscle's full range of motion while exercising. It should be noted that the individual R may easily and quick stop the exercise routine by not pulling at the resistance module 102 when the individual CF is moves in cases of incorrect application of resistance or counteracting force to thereby stop potential injuries.

Figures 1, 8C:
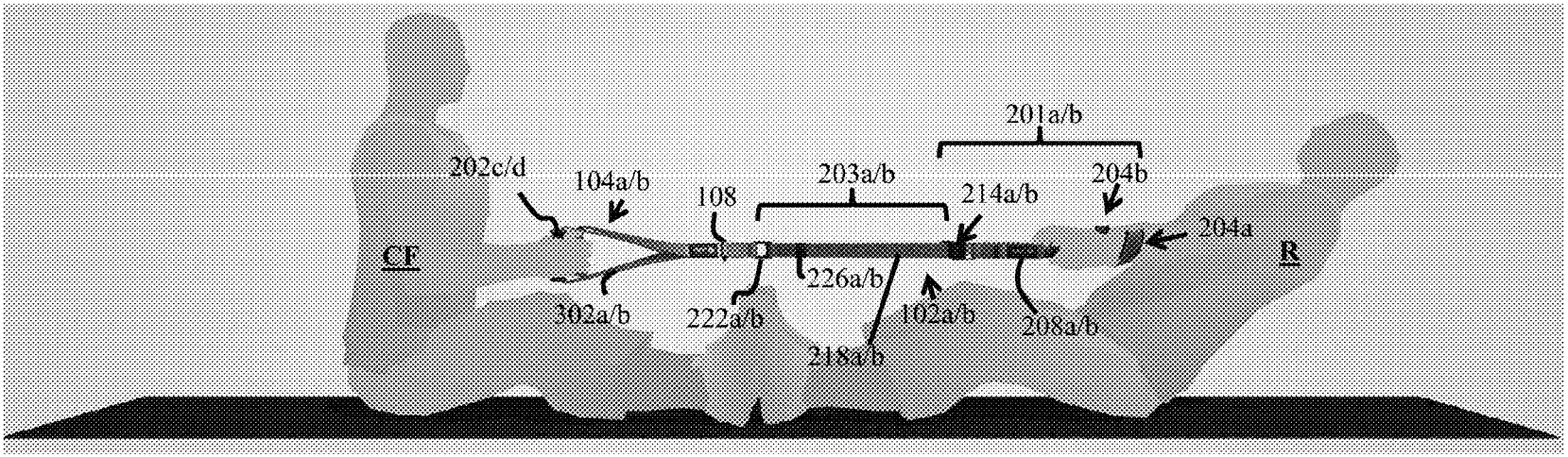
Figures 2, 8C:
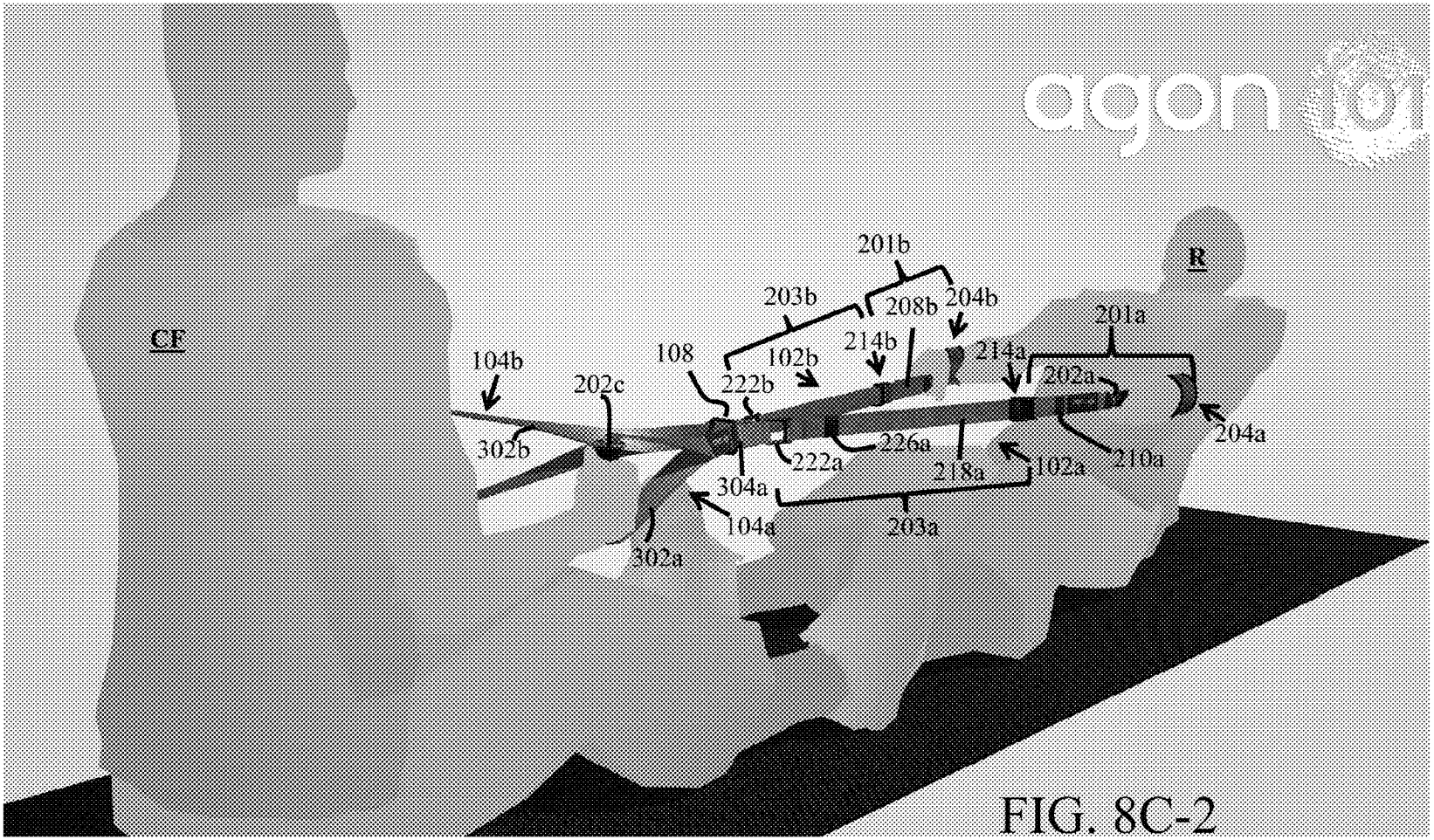

FIGS. 8C-1 and 8C-2 are non-limiting, exemplary illustrations of another exercise routine for back muscles using the exercise device shown in FIGS. 1 to 8G-2 in accordance with the present invention, which is not possible by conventional exercise devices that use adjustable inelastic straps that require a fixed anchor. As illustrated, the exercise device 100 is used in dual mode of operation for this particular routine where resistance modules 102*a* and 102*b* and strengthening modules 104*a* and 104*b* are used. In this exercise routine, the individual R firmly holds the control members 201*a* and 201*b* of the resistance module 102*a* and

102*b* as described above while the individual CF firmly grips the handles 202*c* and 202*d* of the strengthening module 104*a* and 104*b* as illustrated.

With the exercise routing shown in FIGS. 8C-1 and 8C-2, the individual CF moves his or her arms from the illustrated parallel position with respect to the lateral side of the body to back repeatedly to thereby exercise the back and the arms. Simultaneously, the non-stationary, continuously moving individual R varies the resistance experienced by the individual CF in terms of magnitude and direction during the exercise. As best seen in FIG. 8C-2, the individual R may vary the direction and magnitude of the pull, including varying the pull more on one of the left or the right side and hence, vary the pull (hence, the overall resistance) experienced by the individual CF on his or her left side, right side, or both right and left sides, providing a lateral varying and equally varying resistances for the left and right arms during the exercise routine. With this particular exercise, the more pull is provided (regardless of direction) by the individual R, the greater the resistance is experienced by the individual CF.

With the present invention, the individual R may easily provide an adaptive response in terms of resistance and resistance vector to compensate for unbalanced strengths between symmetrical muscle groups (e.g., right-side arm/back muscles verses the left side arm/back muscle groups of the exercising individual CF for the same, identical exercise routine). Hence, if for example, the individual R experiences that the individual CF is constantly pulling stronger with the right arm, then the individual R may balance and adapt the resistance and resistance vector on both resistance module 102*a* and 102*b* for the muscles to compensate and naturally adapt for best muscular response of the individual CF. In other words, the individual R may allow both sides to work independently at the same level of resistance and resistance vector comparatively to their own potential to eventually equalize the right-left side strengths of the individual CF through exercise.

In the non-limiting exemplary exercise routine that is shown in FIGS. 8C-1 and 8C-2, the arm/back muscles of the individual CF when the arms move from the illustrated parallel position to back experience maximum concentric contractions, and when moving from the back position to the illustrated parallel position experience maximum eccentric contractions. If the individual CF decides to maintain the arms/back without moving in mid-way between the parallel and back positions, then the arm/back muscles would experience maximum isometric contractions. Accordingly, with the present invention, the exercise device 100 enables the individual R to vary application of resistance and resistance-vectors experienced by the individual CF for specific parts of the exercise routine to isolate and maximize concentric, eccentric, and isometric contractions of the muscle during a muscle's full range of motion while exercising. For example, the individual R may increase the pull (which means greater resistance experienced by the individual CF) during concentric muscle contraction. This means a more challenging workout experience for the individual CF during concentric contraction of the muscle. On the other hand, the individual R may provide zero resistance (no pull by the individual R) for a weaker workout during eccentric contractions to thereby isolate and maximize concentric-contraction of the muscle during a muscle's full range of motion while exercising. It should be noted that the individual R may easily and quick stop the exercise routine by not pull at all when the individual CF is in the start position in cases of incorrect application of resistance or counteracting force to thereby stop potential injuries.

Figures 1, 8D:
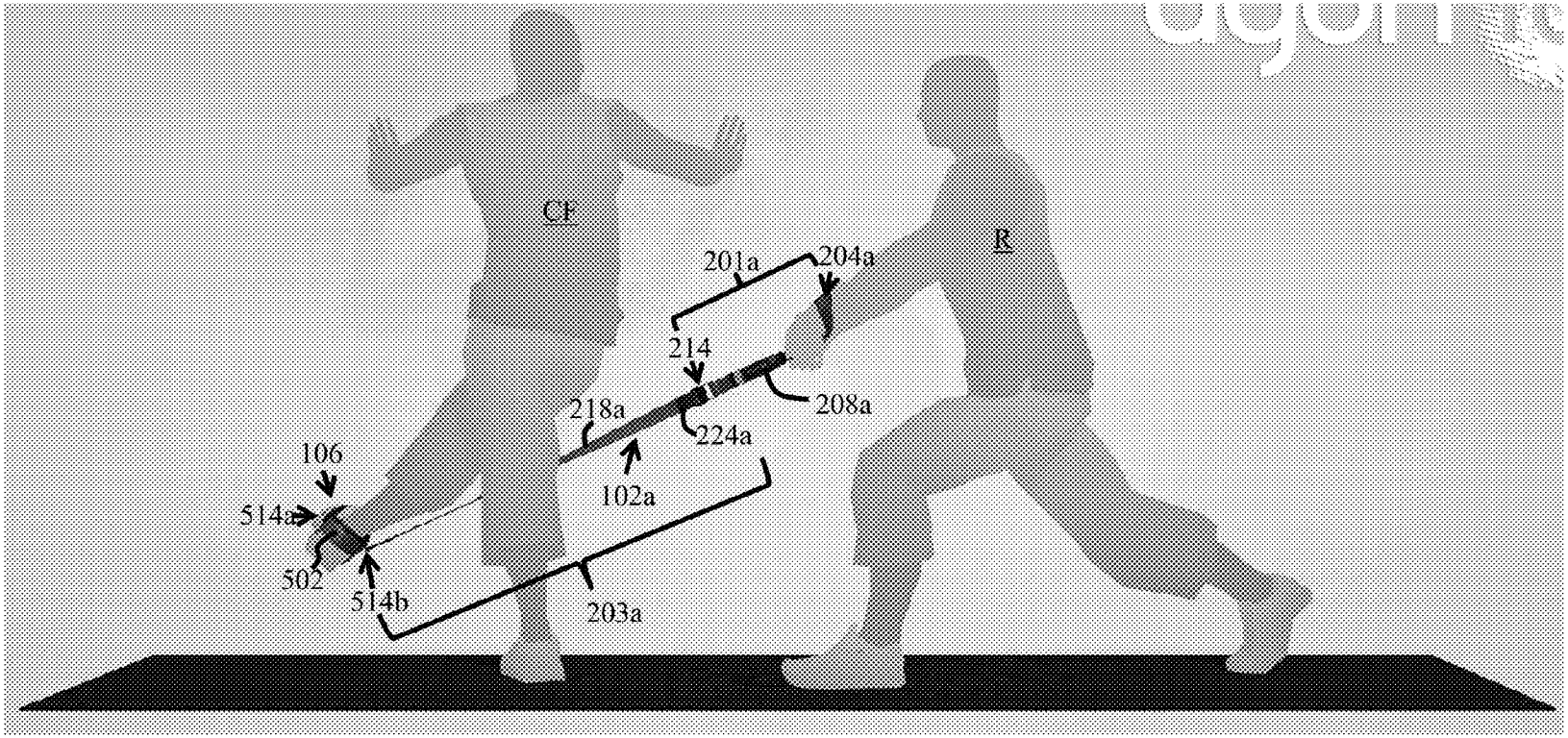
Figures 2, 8D:
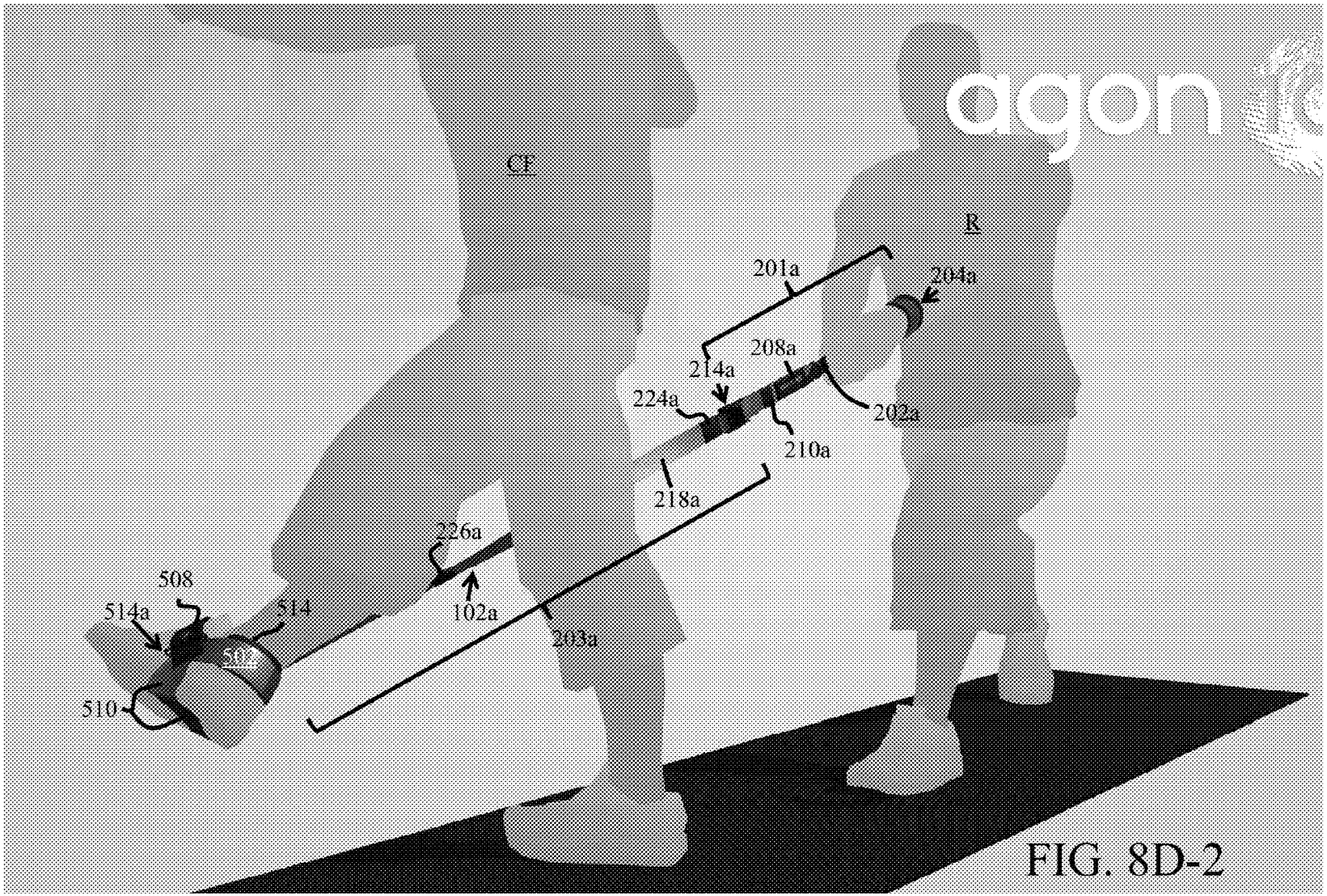

As a specific example, FIGS. 8D-1 and 8D-2 are illustrations of an exercise routine for lower body (inner and outer leg muscles) that use the exercise device 100 of the present invention using the ankle support 106. As illustrated, the exercise device 100 is used in a single mode of operation for this particular routine where a single resistance module 102 is used with the ankle support 106. With this routine, the interlocking mechanism 222 of the adjusting member 203 of the resistance module 102 is connected with only one side (e.g., second attachment mechanism 514*b*) of the ankle support 106.

In this exercise routine, the individual R firmly holds the control member 201 of the resistance module 102 as described above while the individual CF inserts and wears the ankle support 106 as illustrated. With the exercise routing shown in FIGS. 8D-1 and 8D-2, the individual CF moves his or her leg from the straight position (open legs) to the illustrated side position (crossed legs) repeatedly to thereby exercise the adductors muscles (leg muscles). Simultaneously, the non-stationary, continuously moving individual R may vary the resistance experienced by the individual CF in terms of magnitude and direction during the exercise. As best seen in FIG. 8D-2, the individual R may vary the direction and magnitude of the pull, including varying the pull more on one of the left or the right side and hence, vary the pull (hence, the overall resistance) experienced by the individual CF on his or her left leg or right leg, providing a varying resistances for the leg exercise routine. With this particular exercise, the more pull is provided (regardless of direction) by the individual R, the greater resistance is experienced by the individual CF.

With the present invention, the individual R may easily provide an adaptive response in terms of resistance and resistance vector to compensate for unbalanced strengths between symmetrical muscle groups (e.g., right leg verses the left leg muscle groups of the exercising individual CF for the same, identical exercise routine). Hence, if for example, the individual R experiences that the individual CF is stronger with the right leg, then the individual R may balance and adapt the resistance and resistance vector to compensate for the unbalanced right-left side strengths of the individual CF. In other words, the individual R may both sides to work independently at the same level of resistance and resistance vector comparatively to their own potential to eventually equalize the right-left side strengths of the individual CF through exercise.

In the non-limiting exemplary exercise routine that is shown in FIGS. 8D-1 and 8D-2, the leg muscles of the individual CF when moving from the straight to the illustrated side position experience maximum concentric contractions (inner leg muscles), and when moving the opposite direction experience maximum eccentric contractions. If the individual CF decides to maintain the legs without moving in a specific position (e.g., between the straight (or open) and the illustrated crossed positions), then the inner leg muscles would experience maximum isometric contractions. Accordingly, with the present invention, the exercise device 100 enables the individual R to vary application of resistance and resistance-vectors experienced by the individual CF for specific parts of the exercise routine to isolate and maximize concentric, eccentric, and isometric contractions of the muscle during a muscle's full range of motion while exercising. For example, the individual R may increase the pull (which means greater resistance experienced by the individual CF) during concentric muscle contraction of the leg muscles. This means a more challenging workout experience for the individual CF during concentric contraction of the muscle. On the other hand, the individual R may also provide maximum resistance (strong pull by the individual R), but the individual CF may pull back when moving the leg from the illustrated crossed to the straight (open) position in response to the pull of the individual R to provide even a stronger resistance for the eccentric contractions to thereby isolate and maximize concentric and eccentric contractions of the muscle during a muscle's full range of motion while exercising. It should be noted that the individual R may easily and quick stop the exercise routine by not pull at all in cases of incorrect application of resistance or counteracting force to thereby stop potential injuries.

As a specific example, FIGS. 8E-1 to 8F-2 are illustrations of further exercise routines for leg muscles that use the exercise device 100 of the present invention. As illustrated, the exercise device 100 is used in dual mode of operation for these routines where both resistance modules 102*a* and 102*b* are used with the ankle support 106. With these routines, the interlocking mechanisms 222*a/b* of the adjusting members 203*a/b* of the resistance modules 102*a/b* are connected with the second attachment mechanisms 514*a/b* of the ankle support 106. Further with both of these routines, the stabilizer 108 is associated with both of the control members 201*a* and 201*b* of the resistance modules 102*a/b*.

Figures 1, 8E:
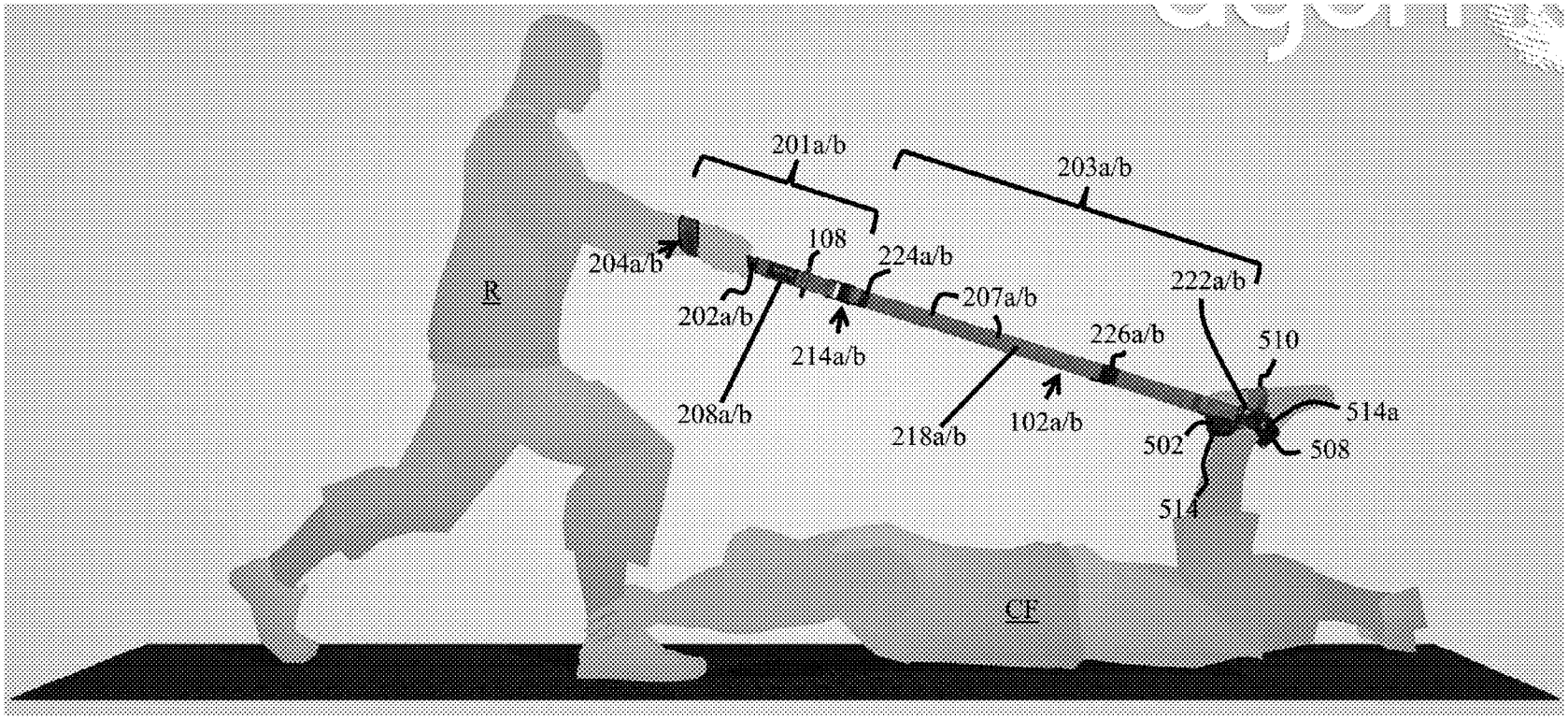
Figures 2, 8E:
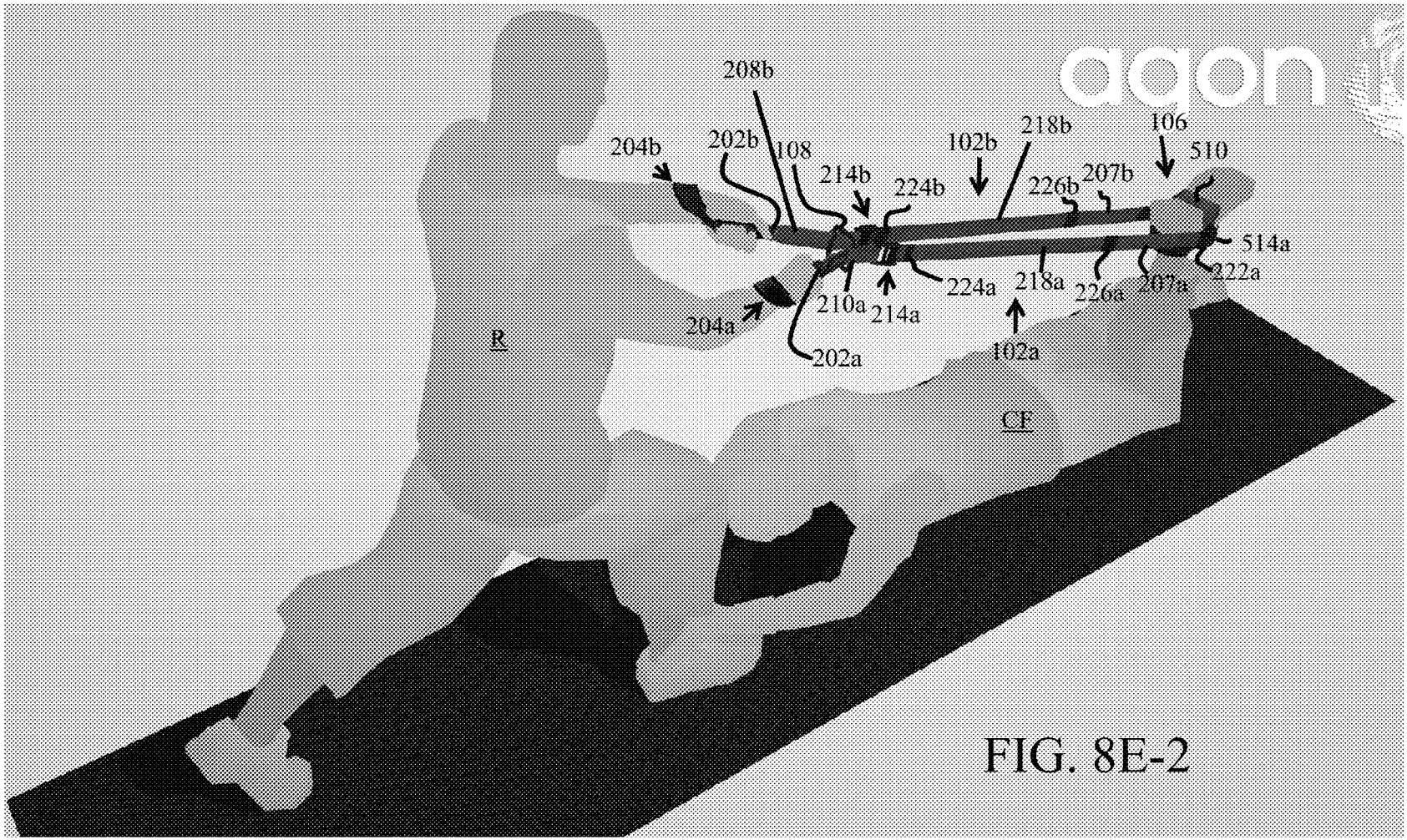
Figures 1, 8F:
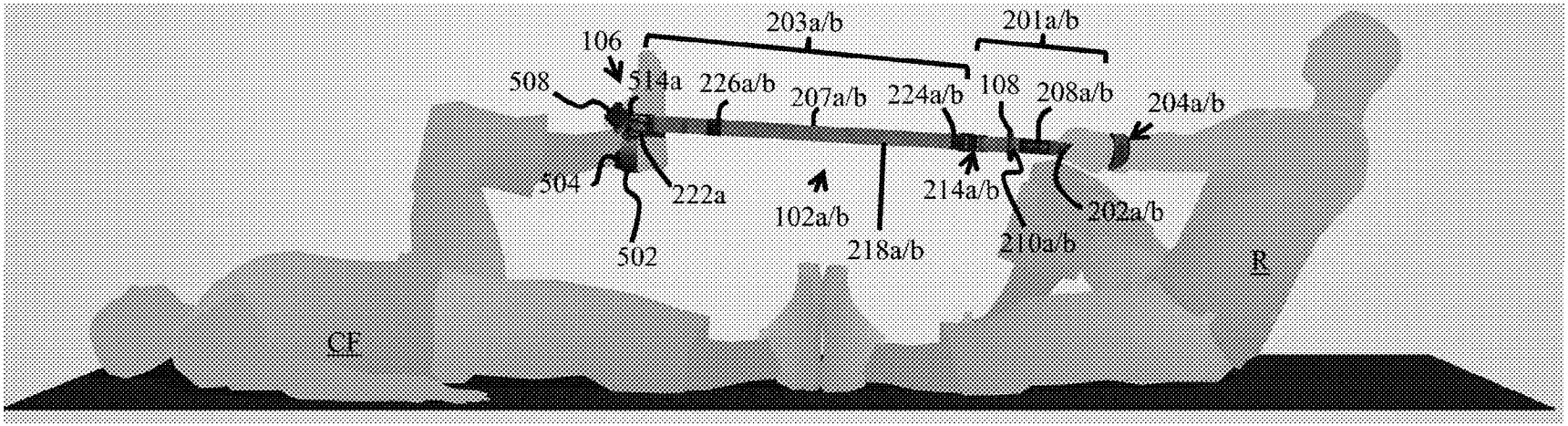
Figures 2, 8F:
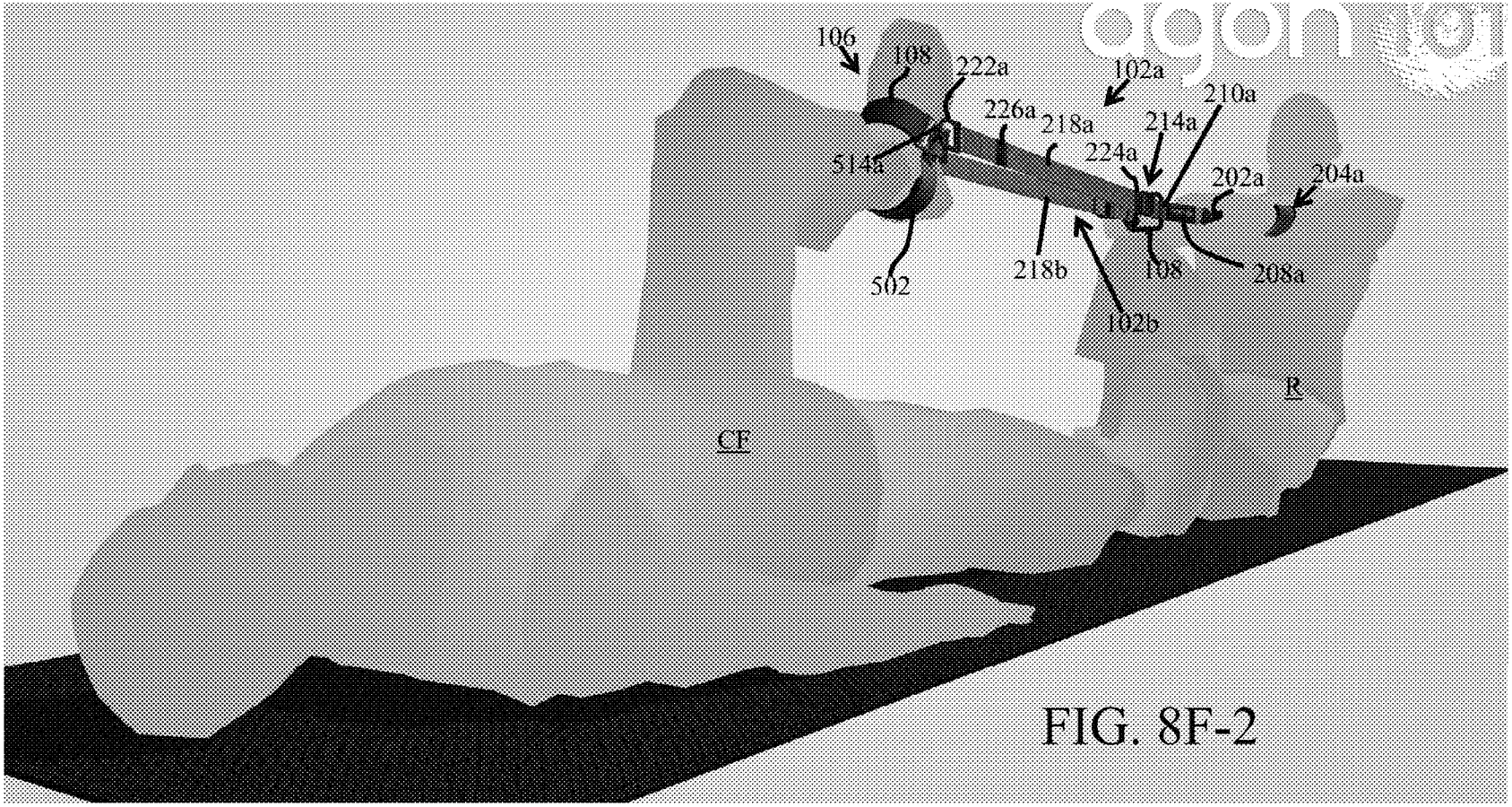

In these exercise routine, the individual R firmly holds the control members 201*a* and 201*b* of the resistance module 102*a* and 102*b* as described above (seating or standing) while the individual CF secures his or her foot/ankle within ankle support 106. With the exercise routines shown in FIGS. 8E-1 to 8F-2, the individual CF performs leg extensions (FIGS. 8E-1 and 8E-2) and knee raises (FIGS. 8F-1 and 8F-2) repeatedly to thereby exercise the leg muscles. Simultaneously, the non-stationary, continuously moving individual R varies the resistance experienced by the individual CF in terms of magnitude and direction during the exercise. As best seen in FIGS. 8E-2 and 8F-2, the individual R may vary the direction and magnitude of the pull, including varying the pull more for the left or the right leg and hence, vary the overall resistance experienced by the individual CF on his or her left or right leg. With this particular exercise, the more pull is provided (regardless of direction) by the individual R, the greater resistance is experienced by the individual CF.

With the present invention, the individual R may easily provide an adaptive response in terms of resistance and resistance vector to compensate for unbalanced strengths between symmetrical muscle groups (e.g., right knee/leg verses the left knee/leg muscle groups of the exercising individual CF for the same, identical exercise routine). Hence, if for example, the individual R experiences that the individual CF has a weaker pull for the left knee/leg, then the individual R may balance and adapt the resistance and resistance vector using resistance module 102*a* and 102*b* to exercise and improve the left knee/leg strength to compensate for the unbalanced right-left side strengths of the individual CF. It should be noted that the use of the illustrated stabilizer 108 associated with one of the strengthening modules 104*a* and 104*b* and that of the resistance modules 102*a* and 102*b* is strongly preferred for these particular routines.

In the non-limiting exemplary exercise routines that is shown in FIGS. 8E-1 to 8E-2, the leg muscles of the individual CF when moving from the illustrated vertical position to extended, horizontal position can experience maximum eccentric contractions, and when moving from the extended horizontal position to the illustrated vertical position experience maximum concentric contractions if needed. As for the non-limiting exemplary exercise routines that is shown in FIGS. 8F-1 to 8F-2, the knee muscles of the individual CF when moving from the straight, extended position to the illustrated bent knee position (at about 90°) vertical position can experience maximum concentric contractions, and when moving from the illustrated raised knee position to the flat, extended position can experience maximum concentric contractions if needed. Accordingly, with the present invention, the exercise device 100 allows the individual R to vary application of resistance and resistance-vectors experienced by the individual CF for specific parts of the exercise routine to isolate and maximize concentric, eccentric, and isometric contractions of the muscle during a muscle's full range of motion while exercising. For example, the individual R may increase the pull (which means greater resistance experienced by the individual CF) during concentric muscle contraction (for either of the knee raise or leg extensions). This means a more challenging workout experience for the individual CF during concentric contraction of the leg muscle. It should be noted that the individual R may easily and quick stop the exercise routine to thereby stop potential injuries.

It should be noted that if there is a large discrepancy between working partners in terms of their weight and strength, the stronger partner exercising may workout the same routine with only single hand or leg rather than both legs or hands. Further, for certain routines, when using the present invention, when the exercising muscles of the person (e.g., individual CF) is experiencing concentric contractions, their partner's (e.g., the individual R) muscles may experience eccentric contractions, which provides simultaneous work out for both participants.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. An exercise device, comprising:

at least a first resistance module that is lengthwise adjustable and is comprised of a generally inelastic first strap;

the first resistance module includes a first non-stationary, movable anchor mechanism comprised of a first longitudinally extending stitched loop of the first strap adapted to be associated with at least one upper extremity of a first user to independently control and continuously change resistance and resistance-vector during exercise;

the first longitudinally extending stitched loop includes a middle loop strap that has a stitched cushion member for added comfort;

a first distal end and a second distal end of the first longitudinally extending stitched loop pass through a first opening of a hollow handle member and egress a second opening of the hollow handle member, enabling the hollow handle member to be longitudinally mounted and moveably secured to the first strap;

the first distal end and the second distal end of the first longitudinally extending stitched loop are stitched together at a first stitching and a second stitching, outside of and past the second opening of the hollow handle member;

the first resistance module further includes a first transversally oriented, laterally positioned stitched loop, that is located between the first stitching and the second stitching;

at least a first strengthening module that is detachably coupled with the first resistance module;

the first strengthening module is comprised of a generally inelastic second strap;

the first strengthening module includes a second non-stationary, movable anchor mechanism comprised of a second longitudinally extending stitched loop of the second strap adapted to be associated with a second user to independently control and continuously adaptively respond with counteracting force and counteracting-vector force to the independently controlled and continuously changing resistance and resistance vector during exercise;

the first strengthening module further includes a second transversally oriented, laterally positioned stitched loop, located between the second longitudinally extending stitched loop and a distal end transversally oriented stitched loop;

a detachable stabilizer that stabilizes motion of the first resistance module and the first strengthening module during exercise when:

either the first resistance module detachably couples with a second resistance module by the detachable stabilizer via the first transversally oriented, laterally positioned stitched loop of the first resistance module and the second resistance module;

or the first strengthening module detachably couples with a second strengthening module by the detachable stabilizer via the second transversally oriented, laterally positioned stitched loop of the first strengthening module and the second strengthening module;

with a maximum range of resistance for the exercise device defined by body weights and body strengths of first and second users as a result of one of an application of the resistance and a responding application of the counteracting force to the resistance.

2. The exercise device as set forth in claim 1, wherein:

the resistance module is comprised of a control member and an adjusting member.

3. The exercise device as set forth in claim 2, wherein:

the control member includes a first end comprised of the first longitudinally extending stitched loop for a firm grip for independent, controlled application of resistance and resistance-vector; and a second end comprised of a first transversally oriented stitched loop of the first strap for coupling with the adjusting member.

4. The exercise device as set forth in claim 3, wherein:

a buckle with a first end is connected to the first transversally oriented stitched loop of the control member of the resistance module, with a second end of the buckle receiving a free, adjusting end of the adjusting member, the free adjusting end looping through the buckle to form a second transversally oriented stitched loop, with the free, adjusting end passing through a first elastic sleeve and connected via a stitching to one interior lateral wall of a second elastic sleeve, with an opposing interior wall free.

5. The exercise device as set forth in claim 4, wherein:

the second elastic sleeve moves longitudinally along a length of the adjusting member to increase or decrease the length of the adjusting member, and the first elastic sleeve moves longitudinally along the length of the adjusting member to appropriately tuck-in any excess slacked portion of the adjusting member.

6. The exercise device as set forth in claim 2, wherein:

a second distal end of the adjusting member of the resistance module is comprised of a third transversally oriented stitched loop, which is connected to an interlock mechanism.

7. The exercise device as set forth in claim 2, wherein:

the control member of the resistance module includes the first transversally oriented, laterally positioned stitched loop to detachably couple with a second control member of the second resistance module by the stabilizer.

8. The exercise device as set forth in claim 2, wherein:

the adjusting member includes marking for relevant adjustment in length of the one or more resistance modules.

9. The exercise device as set forth in claim 1, wherein:

the strengthening module includes:

an elastic sleeve that is connected by stitching at one side, forming a free sleeve at an opposing side for receiving excess strap slack; and a slidably moving ergonomic handle.

10. The exercise device as set forth in claim 1, further including:

an ankle support that detachably couples with the at least a first resistance module.

11. The exercise device as set forth in claim 10, wherein:

the ankle support includes:

a first and second attachment mechanisms that hook onto a respective first and second interlocking mechanisms of the resistance module.

12. The exercise device as set forth in claim 11, wherein:

the ankle support further includes:

an adjusting mechanism that enables adjusting the ankle support for use with different size feet.

13. The exercise device as set forth in claim 11, wherein:
the ankle support further includes:
a cushion support connected to a mid section of a back support.

14. The exercise device as set forth in claim 1, further including:
a portable, foldable, compact carrying case that includes net pockets for storage of the exercise device.

15. An exercise device, comprising:
at least a first resistance module that is lengthwise adjustable and is comprised of a generally inelastic first strap;
the first resistance module includes a first non-stationary, movable anchor mechanism comprised of a first longitudinally extending stitched loop of the first strap adapted to be associated with at least one upper extremity of a first user to independently control and continuously change resistance and resistance-vector during exercise;
the first longitudinally extending stitched loop includes a middle loop strap that has a stitched cushion member for added comfort;
a first distal end and a second distal end of the first longitudinally extending stitched loop pass through a first opening of a hollow handle member and egress a second opening of the hollow handle member, enabling the hollow handle member to be longitudinally mounted and moveably secured to the first strap;
the first distal end and the second distal end of the first longitudinally extending stitched loop are stitched together at a first stitching and a second stitching, outside of and past the second opening of the hollow handle member;
the first resistance module further includes a first transversally oriented, laterally positioned stitched loop, that is located between the first stitching and the second stitching;
at least a first strengthening module that is detachably coupled with the first resistance module;
the first strengthening module is comprised of a generally inelastic second strap;
the first strengthening module includes a second non-stationary, movable anchor mechanism comprised of a second longitudinally extending stitched loop of the second strap adapted to be associated with a second user to independently control and continuously adaptively respond with counteracting force and counteracting-vector force to the independently controlled and continuously changing resistance and resistance vector during exercise;
the first strengthening module further includes a second transversally oriented, laterally positioned stitched loop, located between the second longitudinally extending stitched loop and a distal end transversally oriented stitched loop;
a detachable stabilizer that stabilizes motion of the first resistance module and the first strengthening module during exercise when:
either the first resistance module detachably couples with a second resistance module by the detachable stabilizer via the first transversally oriented, laterally positioned stitched loop of the first resistance module and the second resistance module;
or the first strengthening module detachably couples with a second strengthening module by the detachable stabilizer via the second transversally oriented, laterally positioned stitched loop of the first strengthening module and the second strengthening module;
with a maximum range of resistance for the exercise device defined by body weights and body strengths of first and second users as a result of one of an application of the resistance and a responding application of the counteracting force to the resistance; and
wherein independent application of resistance and resistance-vector are adaptively changed in response to unbalanced counteracting force and counteracting force-vector of a symmetrical set of muscles.

16. An exercise device, comprising:
a resistance module that is lengthwise adjustable and is comprised of a generally inelastic first strap;
the resistance module includes a control member and an adjusting member;
the control member includes:
a first non-stationary, movable anchor mechanism, comprising:
a first longitudinally extending stitched loop of the first strap at a first end of the control member adapted to be associated with at least one upper extremity of a first user to independently control and continuously change resistance and resistance-vector during exercise;
the first longitudinally extending stitched loop includes a middle loop strap that has a stitched cushion member for added comfort;
a first distal end and a second distal end of the first longitudinally extending stitched loop pass through a first opening of a hollow handle member and egress a second opening of the hollow handle member, enabling the hollow handle member to be longitudinally mounted and moveably secured to the first strap;
the first distal end and the second distal end of the first longitudinally extending stitched loop are stitched together at a first stitching and a second stitching, outside of and past the second opening of the hollow handle member;
a second end of the control member includes a first transversally oriented stitched loop for coupling with the adjusting member via a buckle; and
a first transversally oriented, laterally positioned stitched loop that is located between the first stitching and the second stitching;
the adjusting member includes:
the buckle that is used to adjust a length of the adjusting member to thereby vary an overall length of the resistance module;
the buckle has a first end connected to the first transversally oriented stitched loop of the control member, with a second end of the buckle receiving a free, adjusting end of the adjusting member, looping through the buckle to form a second transversally oriented loop of the adjusting member;
a first elastic sleeve through which the free adjusting end of the adjusting member is passed and stitched to an interior lateral wall of a moveable second elastic sleeve which when moved longitudinally along the length of the adjusting member, varies the overall length of the resistance module;
a second distal end of the adjusting member of the resistance module is comprised of a third transversally oriented stitched loop, which is connected to an interlocking mechanism; and
a strengthening module that is comprised of a generally inelastic second strap detachably coupled with the interlocking mechanism of the resistance module through a distal end transversally oriented stitched loop of the strengthening module;

the strengthening module includes a second non-stationary, movable anchor mechanism comprised of a second longitudinally extending stitched loop of the second strap adapted to be associated with an upper extremity of a second user to independently control and continuously adaptively respond with counteracting force and counteracting-vector force to the independently controlled and continuously changing resistance and resistance vector during exercise;

the second non-stationary, movable anchor mechanism further includes a slidably moving ergonomic handle that slides over the second longitudinally extending stitched loop of the second strap;

the strengthening module further includes a second transversally oriented, laterally positioned stitched loop, located between the second longitudinally extending stitched loop and the distal end transversally oriented stitched loop; and a detachable stabilizer that stabilizes motion of the resistance module and the strengthening modules during exercise when:

either the resistance module is detachably coupled with a second resistance module by the detachable stabilizer via the first transversally oriented, laterally positioned stitched loop of the resistance module and the second resistance module;

or the strengthening module is detachably coupled with a second strengthening module by the detachable stabilizer via the second transversally oriented, laterally positioned stitched loop of the strengthening module and the second strengthening module;

with a maximum range of resistance for the exercise device defined by body weights and body strengths of first and second users as a result of one of an application of the resistance and a responding application of the counteracting force to the resistance.

17. An exercise device, comprising:

a resistance module that is lengthwise adjustable and is comprised of a generally inelastic first strap;

the resistance module includes a control member and an adjusting member;

the control member includes:

a first non-stationary, movable anchor mechanism, comprising:

a first longitudinally extending stitched loop of the first strap at a first end of the control member adapted to be associated with at least one upper extremity of a first user to independently control and continuously change resistance and resistance-vector during exercise;

the first longitudinally extending stitched loop includes a middle loop strap that has a stitched cushion member for added comfort;

a first distal end and a second distal end of the first longitudinally extending stitched loop pass through a first opening of a hollow handle member and egress a second opening of the hollow handle member, enabling the hollow handle member to be longitudinally mounted and moveably secured to the first strap;

the first distal end and the second distal end of the first longitudinally extending stitched loop are stitched together at a first stitching and a second stitching, outside of and past the handle member;

a second end of the control member includes a first transversally oriented stitched loop for coupling with the adjusting member via a buckle; and a first transversally oriented, laterally positioned stitched loop that is located between the first stitching and the second stitching;

the adjusting member includes:

the buckle that is used to adjust a length of the adjusting member to thereby vary an overall length of the resistance module;

the buckle has a first end connected to the first transversally oriented stitched loop of the control member, with a second end of the buckle receiving a free, adjusting end of the adjusting member, looping through the buckle to form a second transversally oriented loop of the adjusting member;

a first elastic sleeve through which the free adjusting end of the adjusting member is passed and stitched to an interior lateral wall of a moveable second elastic sleeve which when moved longitudinally along the length of the adjusting member, varies the overall length of the resistance module;

a second distal end of the adjusting member of the resistance module is comprised of a third transversally oriented stitched loop, which is connected to an interlocking mechanism; and a strengthening module in a form of an ankle support that detachably couples with the interlocking mechanism of the resistance module;

the ankle support includes:

an adjustment mechanism that enables adjusting size of the ankle support and a cushion support connected to a mid section of a back support.

18. The exercise device as set forth in claim 17, further including:

a detachable stabilizer that stabilizes motion of the resistance module and the ankle support during exercise when the resistance module is detachably coupled with a second resistance module by the detachable stabilizer via the first transversally oriented, laterally positioned stitched loop of the resistance module and the second resistance module.

* * * * *